United States Patent [19]

Aoki et al.

[11] Patent Number: 4,845,528

[45] Date of Patent: Jul. 4, 1989

[54] DOUBLE-SIDE IMAGE FORMING APPARATUS

[75] Inventors: Tomohiro Aoki, Yokohama; Kazuo Kawakubo, Chigasaki; Katsushi Furuichi, Yokohama; Kiyokazu Namekata, Machida; Hidetoshi Tanaka, Musashino; Yoshikuni Tohyama; Toshirou Kasamura, both of Yokohama; Toshio Honma, Tokyo, all of Japan

[73] Assignee: Canon Kabushiki Kaisha, Tokyo, Japan

[21] Appl. No.: 135,555

[22] Filed: Dec. 16, 1987

Related U.S. Application Data

[63] Continuation of Ser. No. 792,314, Oct. 28, 1985, abandoned, which is a continuation of Ser. No. 503,311, Jun. 10, 1983, abandoned, which is a continuation of Ser. No. 219,587, Dec. 23, 1982, abandoned.

[30] Foreign Application Priority Data

| | | | |
|---|---|---|---|
| Dec. 28, 1979 | [JP] | Japan | 54-171347 |
| Dec. 28, 1979 | [JP] | Japan | 54-171348 |
| Aug. 8, 1980 | [JP] | Japan | 65-108837 |
| Aug. 13, 1980 | [JP] | Japan | 65-111467 |

[51] Int. Cl.[4] ..... G03G 21/00

[52] U.S. Cl. ..... 355/210; 355/314; 355/319; 355/211

[58] Field of Search ..... 355/3 R, 3 SH, 14 R, 355/14 SH, 14 C, 24, 25, 26

[56] References Cited

U.S. PATENT DOCUMENTS

| | | | |
|---|---|---|---|
| 4,067,649 | 1/1978 | Hubbard et al. | 355/14 |
| 4,099,860 | 7/1978 | Connin | 355/14 |
| 4,110,032 | 8/1978 | Hubbard et al. | 355/14 |
| 4,123,155 | 10/1978 | Hubert | 355/26 |
| 4,162,848 | 7/1979 | Platt | 355/14 C |
| 4,327,993 | 5/1982 | Gauronski et al. | 355/14 SH |
| 4,437,756 | 3/1984 | Kawakubo et al. | 355/14 R |

*Primary Examiner*—Fred L. Braun

*Attorney, Agent, or Firm*—Fitzpatrick, Cella, Harper & Scinto

[57] ABSTRACT

A double-sided image forming apparatus having first and second input devices respectively for entering function data for desired image formation functions and for entering the number of copies to be formed. A memory is provided to store the function data, and a storage compartment is provided to store sheets during duplex copying. An image forming device is arranged to operate in two procedures: a first procedure in which image formation is effected on the sheet's first side in accordance with first function data, and a second procedure in which image formation is effected on the other side in accordance with a second, different, function data. A controller controls the image forming device so that entry of number data and function data is permitted before the first procedure begins, but so that entry of only function data and not number data is permitted after completion of the first procedure. A detecting device is provided to detect the presence of sheets in the storage compartment, and the controller operates until sheets are no longer detected.

10 Claims, 26 Drawing Sheets

NO SHT (UP)
NO SHT (LOW)
NO SHT (BOTH)
JPF
CL4
CL3
CL2
CL1
I/O - 2
I/O - 3
I0
I1
I2
I3
O0
O1
O2
O3
CS
DB
R/W
Res
Φ
G
4
OBP
OHP
CP
DHP
P·I
HVT2
HVT1
SSR
AC
DC
T
M2
M1

RAM MAP (000 — OFF)

| #'0' | 0 | 1 | 2 | 3 | 4 | 5 | 6 | 7 |
|---|---|---|---|---|---|---|---|---|
| 0 | WR0 COPY FLAG | | WA0 | | WR1 | | WA1 | |
| 1 | WR4 | | WA4 | | WR5 | KEY COUNTER WAIT ORIGINAL EXCHANGE (INTRPT.) | WA5 | |
| 2 | CNT1 | NO. OF SET | | JAM SORTER JAM TONER NO SHEET | | | SIDE 1 SIDE 2 REPT. TRAY EXH. KEY | 1.0 0.7 0.6 DARK |
| 3 | CNT2 | NO. OF COPY | | | | SIDE 1 SAVE (MODE 1) | | |
| 4 | CNT3 | NO. OF FINISH | | | | SIDE 2 SAVE (MODE 2) | | |
| 5 | CNT4 | SET SAVE | | | | INTERRUPTION SAVE (MODE INTRPT.) | | |
| 6 | CNT5 | COPY SAVE | | | | | | |

FIG. 5A

| | JAMS | JAM1 | JAM2 | STOPS | STOP1 | STOP2 | PEMPS | PEMP1 |
|---|---|---|---|---|---|---|---|---|
| 7 | | | | | | | | |
| 8 | | | | | | | | |
| 9 | | | | | | | | |
| A | | | | | | | | |
| B | | | | | | | | |
| C | | | | | | | | |
| D | | | | | | | | |
| E | | | | | | | | |
| F | | | | | | | | |

FIG. 5C

FIG. 5D

| PEMP2 | IRPT INTER-RUPTION | KEY LIMIT FLAG | EXHAUST SW FLAG | IN-BOTH SIDES INTRPT. FLAG | | | | |
|---|---|---|---|---|---|---|---|---|
| | | | | | | | | |
| | | | | | | | | |
| | | | | | | | | |
| | | | | | | | | |
| | | | | | | | | |
| | | | | | | | | |
| | | | | | | | | |
| | | | | | | | | |

POWER ON
I/O CLEAR
RAM CLEAR
STEP 1
SET NUMBER ← 1
COPY NUMBER ← 0
TO SET MODE IN:
MAGNIFICATION ; 1
DENSITY ; ORDINAL
OUTLET ; TRAY
MODE ; SINGLE
CASSETTE ; LOWER
STEP 2
C
KEY INPUT ?
NO
YES
KEY INPUT READING KEY

DOUBLE-SIDE IMAGE FORMING APPARATUS

This application is a continuation of application Ser. No. 792,314 filed 10/28/85, which in turn is a continuation of Ser. No. 503,311 filed 6/10/83, which in turn is a continuation of Ser. No. 219,587 filed 12/23/82, all of which are now abandoned.

BACKGROUND OF THE INVENTION

1. Field of the Invention

The present invention relates to a double-side image forming apparatus capable of forming images on both faces of a sheet-shaped image bearing member.

2. Description of the Prior Art

In conventional image forming apparatus such as copiers, the reproduced image is generally formed only on one face of the sheet-shaped image bearing member or copy sheet. However such copy sheets, when stored in bulk, require twice the space and weight in comparison with double-faced documents such as books. Double-side image forming apparatus are required also in consideration of the economy in resources, labor power and cost.

In the following description the present invention will be explained by a double-side copier as an example of such apparatus. In a copier employing an image transfer process, double-sided copying can be achieved in the following systems.

In a first process, different images are formed respectively on two photosensitive drums for top face and bottom face, and transferred to both faces of the copy sheet.

This system, though simple in principle, is disadvantageous in requiring a large expensive apparatus because of the necessity for two independent copying processes.

In a second system a first image formed on a photosensitive drum is transferred to an intermediate drum for temporary storage, then a second image is again formed on the photosensitive drum, and said images are transferred respectively from said intermediate drum and photosensitive drum to the copy sheet. This system requires only one copying process but is disadvantageous in different image quality between the top face and the bottom face.

In a third system the ordinary one-side copying is made on a face of the copy sheet, and the completed copy sheet is inverted and returned to the original paper feed section or another paper feed section for copying again on the bottom face.

In contrast to the first or second system associated with the drawback in cost and dimension of the apparatus or in the image quality, the third system is considered most practical for realizing a simple and compact double-side copier, requiring only one copying process as in the one-side copying.

However the third system is often confronted by other troubles such as paper jamming because each copy sheet has to go through a longer path in comparison with the ordinary one-side copying and also because each copy sheet of which surface conditions have been modified by the steps of image transfer and fixing has to be again subjected to the steps of paper feeding, image transfer and fixing for the second time.

SUMMARY OF THE INVENTION

The object of the present invention is to provide a double-side image forming apparatus capable of eliminating these drawbacks, and more specifically a double-side image forming apparatus having input means for entering the number of desired image formations for forming images on both faces of a sheet-shaped image bearing member and a storage section for storing said image bearing member after image formation on a first face thereof, said apparatus being adapted, when the image formation on the first face of said image bearing members is interrupted before the completion of said desired number of image formations, to conduct in continuation the image formation on the second face of the image bearing members stored in said storage section.

Another object of the present invention is to provide a double-side image forming apparatus capable of conducting image formation in a first mode on a first face of the sheetshaped image bearing member, then storing said image bearing member in a storage section and then conducting image formation on a second face in a second mode, being featured in interrupting image formation in the second mode in response to an interruption signal and maintaining said second mode until the receipt of an image formation instruction signal.

DESCRIPTION OF THE PREFERRED EMBODIMENTS

Now the present invention will be clarified in detail by the description of embodiments thereof to be taken in conjunction with the attached drawings.

Figure 1:
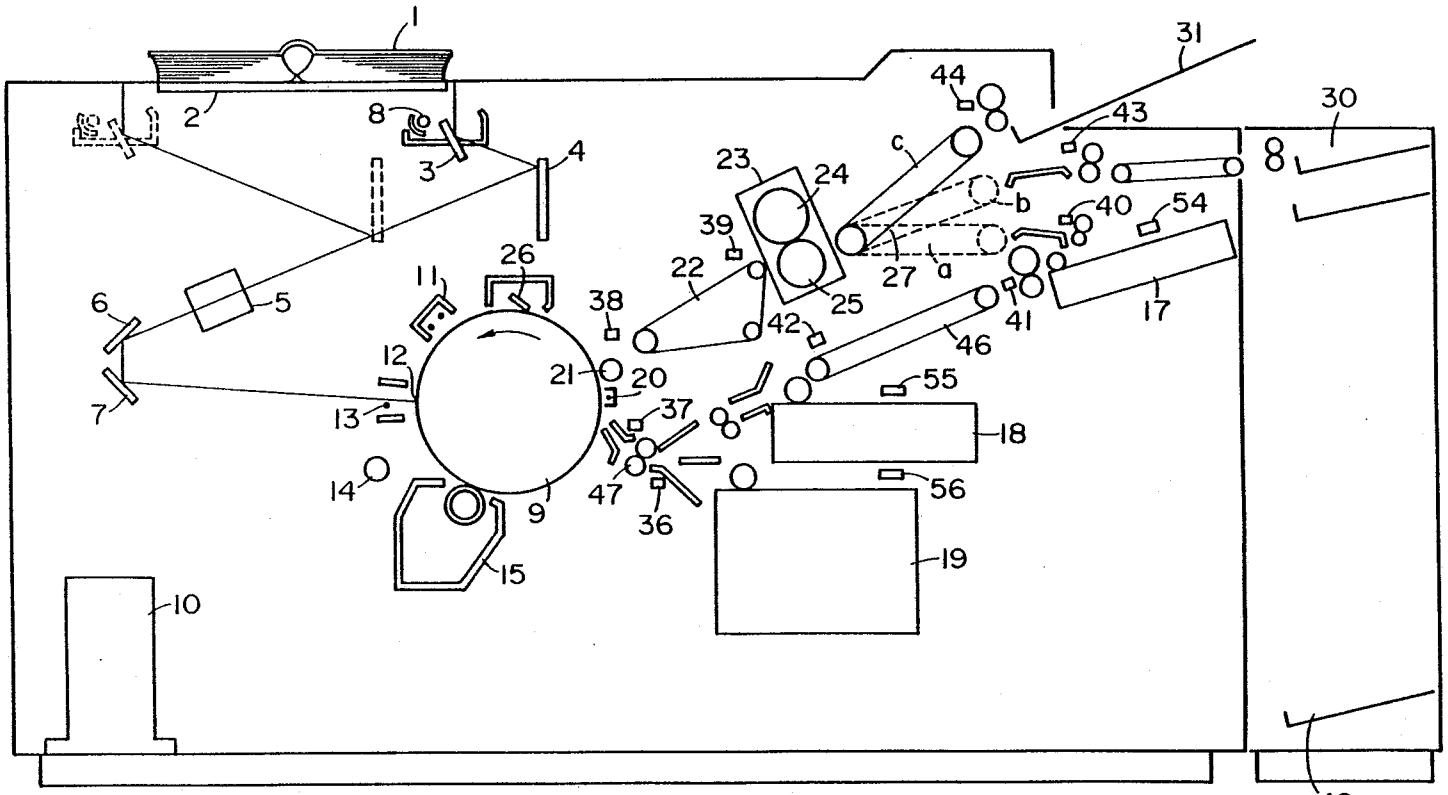
FIG. 1 is a cross-sectional view of a double-side copier in which the present invention is applicable.
Figure 2:
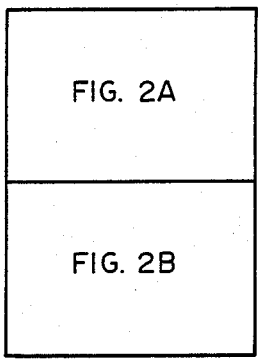
FIG. 2 is a composite of FIGS. 2A and 2B which show a plan view of the display and control unit of the copier shown in FIG. 1.

FIG. 1 shows an embodiment of the present invention in a cross-sectional view illustrating the sheet transport path in a double-side copier, of which the control section is shown in FIG. 2.

At first there will be explained the function of the copier in the ordinary single-side copying.

Referring to FIG. 1, an original 1 is placed on a transparent plate 2 of the original carriage, and an exposing optical system is composed of movable mirrors 3, 4, a lens 5 and fixed mirrors 6, 7. Thus the original 1 is slit exposed by the displacement of the movable mirror 3 structured integrally with an illuminating lamp 8 and the displacement of the movable mirror 4 in the same direction but at a half speed to maintain a constant optical path length and the reflected light from the original is focused on a photosensitive drum 9 through said lens 5 and fixed mirrors 6, 7.

On the periphery of the photosensitive drum 9 there is provided a photoconductive layer covered with a transparent insulating layer to constitute a photosensitive member, which is at first charged positively by a positive charger 11 receiving a positive high voltage from a high voltage source 10.

In an exposure station 12 the image of the original 1 illuminated by the lamp 8 is exposed to the drum 9 through the movable mirrors 3, 4, lens 5 and fixed mirrors 6, 7.

Simultaneously with the exposure of the original image the drum 9 is subjected to an AC discharge by an AC discharger 13 receiving an AC high voltage from the high voltage source 10. Subsequently an electrostatic latent image is formed on the photosensitive drum by a flush exposure by a whole-surface exposure lamp 14 and introduced in to a developing station 15.

Said latent image is rendered visible by toner development with a magnetic sleeve. The copy sheet 16 is supplied from an intermediate tray 17 or a first paper feed station, both structured as cassettes, or a second paper feed station 19 structured as a deck having an automatic elevator and capable of supporting a stack of copy sheets. Said intermediate tray 17 is also utilized as the paper feed station in the double-side copying as will be further explained later.

The copy sheet 16 supplied from the paper feed station 17, 18 or 19 is brought into contact with the drum 9, and the developed image thereon is transferred onto the copy sheet by a positive discharge from a transfer charger 20 powered by the high-voltage source 10. The copy sheet after the image transfer is separated from the drum 9 in a separating station 21 and guided through a conveyor 22 to a fixing station 23.

Said fixing station 23 is provided with a heated fixing roller 24 and a rubber-clad pressure roller 25 between which the copy sheet is passed to fix the toner image thereto by heat and pressure.

On the other hand the drum surface is cleaned by a contacting blade 26 for removing the remaining toner, and is thus prepared for the succeeding imaging cycle. The copy sheet 16 passing through the fixing station 23 is advanced to a conveyor 27 which is automatically switchable to a transfer position (a) (shown by full line) to the intermediate tray 17 for double-side copying, a transfer position (b) to a sorter 30 or a transfer position (c) to a copy sheet tray 31 (the latter two being shown by broken lines) in response to the mode selection by a "tray" button 77 or a "sorter" button 78 shown in FIG. 2. The foregoing process is automatically conducted by the actuation of a copy start button 35 after the entry of a desired copy number by numeral keys 34. Also as shown in FIG. 2, there are provided display units for indicating the selected copy number and the completed copy number. The upper display unit 61 indicates the selected copy number entered by the numeral keys 34, while the lower display unit 62 indicates the number of completed copies. For example, in case 20 copies are instructed by the numeral keys 34, the upper display unit 61 indicates "020" while the lower display unit 62 is step advanced from "000" to "001", "002" and so on to "020" when the copying operation is terminated. Instead of such so-called addition type display, the display unit 62 may have subtraction type display in which the displayed number is decreased from "020" to "019", "018" and so on and finally to "000". Though the display unit 62 may be realized in the addition type or subtraction type in this manner, the following description will be based on the addition type display.

Along the above-explained sheet transport path there are provided paper jamming detectors 36–44 to perform the following functions in case of a paper jam detection:

(I) In case of a paper jam detection by the detector 36, 37 or 38, the copy sheets present in the transport path after the separating station 21 (separating station itself not included) are ejected to the preselected outlet, for example the tray or the sorter. The sheet eventually present on the conveyor 22 is ejected after the normal fixing step, but all other process steps such as exposure, charging, development and image transfer are interrupted, and all the copy sheets thus ejected are regarded as normal copies. The copy sheets remaining in the apparatus are to be removed according to the jam display, and are not counted as the completed copies.

(II) In case a sheet jamming is detected by the detector 39, 43 or 44, the copy sheets present after said detector are ejected in the normal manner but the other process steps are all interrupted. The counting of completed copies and the jam display are performed in the same manner as in the case (I).

Also the intermediate tray 17, first paper feed station 18 and second paper feed station 19 are respectively provided with detectors 54, 55 and 56 for detecting the presence of copy sheets.

Now there will be explained the procedure of double-side copying.

In the present embodiment standard modes are predetermined for various copying conditions for achieving a standard copying such as "single side" copy with a "normal" density for "tray" ejection in FIG. 2, and are automatically selected at the turning on of the power supply to the apparatus. Besides any other mode eventually selected automatically returns to said standard mode in case the copy start button 35 is not actuated for a determined period. In this manner the apparatus can always be maintained in a state convenient for the operator.

Upon actuation of a "double-side" button 80 for selecting the double-sided copying mode, the apparatus is readied for a first-face copying mode in which a lamp PL9 is lighted to indicate the copying for the first side of the copy sheet, and the conveyor 27 is switched to the position (a). In the second-face copying to be explained later, a lamp PL10 is lighted to indicate the second-face copying, thus facilitating the control by the operator.

Copy mode selector buttons 71–82 are respectively provided thereabove with light-emitting diodes LED1 - LED12 for indicating the selected mode when said buttons are actuated.

The copying operation is initiated after the selection of other copying conditions and the entry of copy number, but, in the first-face copying in the double-side copy mode, the copy sheet supply cannot be made from the intermediate tray 17 but only from the first or second paper station 18 or 19. In case a copy sheet is already present in such first-face copying, a lamp PL11 is lighted to indicate a message "to remove the sheet in the intermediate tray", and the copying operation cannot be initiated until said sheet is removed by the operator.

After the start of the copying operation, all the mode selector buttons are disabled to prohibit the mode alteration, except a "stop" button 45. The process steps of exposure, development, image transfer and fixing are performed in the same manner as in the single-side copying, and the copy sheet 16 from the fixing station 23 is transferred through the conveyor 27 to the intermediate tray 17 is such a manner that the leading end of said copy sheet is housed at the rear end, opposite to the paper feed outlet, in said intermediate tray 17.

As shown in FIG. 1, the intermediate tray 17 is sloped downwards to the paper feed outlet, whereby the copy sheets contained therein are aligned by the weight thereof at said outlet to facilitate the paper supply at the subsequent second-face copying.

The first-face copying is completed when the copy sheets of the selected copy number are stored in the intermediate tray 17. At the same time the lamp PL10 is lighted to instruct the operator to place an original for the second-face copying, and the conveyor is switched to the predetermined outlet. In this state the copying conditions suitable for the second-face copying are selected, but the transfer to the single-side copying is disabled. In response to a copy start signal for the second-face copying, the copy sheets in the intermediate tray 17 are supplied in succession to a conveyor 46 and transported to the selected outlet while the process steps of exposure, development, image transfer and fixing are conducted in the same manner as in the first-face copying.

The image reproduced in said second-face copying is applied to the bottom face of each copy sheet already having an image on top face thereof formed in the preceding first-face copying. Upon completion of the second-face copying on all the copy sheets stored in the intermediate tray 17, the lamp PL10 is extinguished while the lamp PL9 is again lighted to indicate the first-face copying mode, thus preparing for the succeeding double-side copying operation. However, in case the succeeding double-side copying is not initiated within a determined period, the apparatus automatically returns to the normal single-side copying mode as explained in the foregoing. It is also possible to shift the apparatus to the single-side copying mode within said period by actuating the button 79.

As the copy sheets in the intermediate tray 17 may be disaligned in the direction perpendicular to the sheet advancing direction, the conveyor 46 is provided with an unrepresented mechanism for lateral registration, which, in cooperation with a registering roller 47, functions to supply the copy sheets to the image transfer step with exact registration in both directions.

Now, for the purpose of clarity of the following description, there will be give definitions of the terms "standard mode", "copy mode", "single-side copy mode" indicating the function in the single-side copying, and "first-face copy mode" and "second-face copy mode" in the first and second face copying in the double-side copying as follows:

"Copy mode" means various functions of the copier selectable by the operator, or, in the present embodiment, the functions shown in the control unit in FIG. 2.

"Standard mode" means a normal copying mode automatically selected at the turning on of the power supply to the copier or after the lapse of a determined period without copying operation, and includes the following conditions in the present embodiments:

image magnification: 1:1
copy density: normal
copy outlet: tray
copying: single-sided
copy number: 001
completed copy number: 000.

"Single-side copy mode": In the copying modes including the instruction of single-side copying, the conveyor 27 is automatically switched to a selected outlet (position (b) or position (c)) in response to the copy start signal, and the copy sheet is supplied from the first or second paper feed station 18, 19 or the intermediate tray 17 and is ejected from the selected outlet through the conveyor 27 after the process steps of exposure, development, image transfer and fixing are performed.

"First-face copy mode": Upon selection of the "double-side copy" there is given an indication for the "first-face copy", and the conveyor 27 is switched to the position (a) in response to the copy start signal after the selection of other copying modes. The copy sheet is supplied from the first or second paper feed station 18, 19 selected in advance, and advanced to the intermediate tray 17 through the conveyor 27 after the process steps of exposure, development and image transfer.

After the copy sheets of the selected copy number (though there exist certain exceptions as will be explained later) are stored in the intermediate tray 17, the apparatus is stopped and the display for the "second-face copy" is automatically given.

"Second-face copy mode": After the selection of copying modes (except for the outlet, copy number and single-side or double-side which are already selected prior to the first-face copying) and in response to the copy start signal, the conveyor 27 is switched from the position (a) to the selected outlet position (b) or (c). The copy sheets are supplied from the intermediate tray 17 to receive on the second faces the images formed by the process steps of exposure, development, image transfer and fixing, the ejected to the selected outlet. After the ejection of copy sheets of the selected copy number (except for certain cases as will be explained later) the apparatus is stopped and the display for the "first-face copy" is given.

In the following explained are the procedures in case of sheet jamming or multiple sheet supply or for special instruction in the course of the double-side copying operation.

(I) In case the "stop" button 45 is actuated during the first-face copying, the copying operation is immediately terminated. The number of copy sheets having completed the first-face copying (number of sheets in the intermediate tray 17) is automatically displayed as the selected copy number for the second-face coping, and the lamp PL10 is lighted to shift the copier to the second-face copying mode. The actuation of "stop" button during the first-face copying becomes necessary principally in case of an erroneous selection in the copy number, image density or outlet, or an erroneously placed original document. If the copy number can be modified in this state for continuing the first-face copying and thus modified copy number is used as the selected copy number for the second-face copying, the number of copy sheets stored in the intermediate tray 17 becomes different from the selected copy number for second face.

Also it is not advisable to automatically use the sum of the number of copy sheets in the intermediate tray 17 and the newly selected copy number as the copy number for the second face, since the copy sheets in the intermediate tray 17 may not require the copying for the second face due to some errors in the first-face copying.

For these reasons, in response to the "stop"instruction during the first-face copying, the apparatus terminates the first-face copying at this point and is automatically shifted to the second-face copying mode, whereupon the second-face copying can be initiated if the copy sheets in the intermediate tray 17 are regarded as normal by the operator.

Also in case said copy sheets are regarded as erroneous, the first-face copying can be conducted again from the beginning after said copy sheets are removed from the intermediate tray 17. In such case said removal of the copy sheets is detected automatically to shift the apparatus to the first-face copy mode with a corresponding display.

In such case the selection of all the copy modes becomes enabled.

Said copy sheet removal from the intermediate tray 17 can be achieved either manually or by the actuation of a "removal" button 48 shown in FIG. 2, in response to which the paper transport mechanisms are activated to automatically transport the copy sheets from the intermediate tray 17 without the steps of exposure, development, image transfer and fixing through the conveyors 46, 22 and 27 in the position (b) or (c) to the tray 31 or a predetermined bin in the sorter 30. In the present embodiment the lowermost tray of the sorter 30 is assigned as a dust box 49 into which thus removed copy sheets are automatically supplied.

Also said tray 31 is provided with a sheet sorting function by the swinging motion of the tray as disclosed in the Japanese Patent Laid-Open No. Sho54-41732, and is set in said swinging motion at said copy sheet removal to separate such removed copy sheets from the normal copy sheets, whereby the operator can easily distinguish the erroneous copy sheets from the normal ones both in the tray 31 and the sorter 30.

(II) In case the copy sheets are exhausted in the first or second paper feed station 18, 19 during the course of the first-face copying, the first-face copying mode is terminated at this point in the same manner as the "stop" button 45 is actuated in the foregoing item (I), whereby the number of copy sheets stored in the intermediate tray 17 is automatically displayed as the selected copy number for the second-face copying mode and the lamp PL10 is lighted to shift the apparatus to the second-face copying mode for starting the second-face copying upon receipt of the copy start signal. The completed copy number is step advanced with the progress of the copying cycles, and the second-face copying mode is terminated when the completed copy number becomes equal to the selected copy number. Upon completion of said second-face copying mode, there are displayed the originally selected copy number and the completed copy number, and the lamp PL9 is lighted to indicate the first-face copying mode, in which the operator can demand the deficient copies in the following procedure.

The apparatus is made ready for the copying cycles for such deficient copies by replenishing copy sheets to the first or second paper feed station 18, 19 in which the copy sheets are exhausted. The first-face copying is initiated by the actuation of the copy start button 35, and the number of copies is added to the completed copy number mentioned above. When the completed copy number becomes equal to the selected copy number mentioned above, the apparatus terminates the first-face copying mode and is shifted to the second-face copying mode, in which given are displays of the originally selected copy number and the completed copy number same as those displayed prior to the start of the second first-face copying mode.

Then the second-face copying is initiated by the copy start signal whereby the number of copies is added to the above-mentioned completed copy number, and said second-face copying mode is terminated when said completed copy number becomes equal to the selected copy number, thus providing the double-sided copies of a number initially selected.

For the purpose of clarity, the above-explained procedure will be explained again by the following numerical example. It is now assumed that 20 copies are required but the paper feed station contains only 15 copy sheets. In the initial first-face copying mode, "20" and "0" are displayed respectively for the selected copy number and the completed copy number. After the copying cycles are initiated by the copy start signal, said displays are step advanced in the order of "20-1", "20-2", . . . , "20-11", "20-12", "20-13", . . . , and the completed copy sheets are introduced into the intermediate tray 17. The copy sheets in the paper feed station are exhausted when displays "20-15" are obtained, whereby the first-face copying mode is terminated.

Thus the second-face copying mode is automatically enabled, and simultaneously said displays are changed form "20-15" to "15-0" indicating a newly selected copy number of 15 copies.

The second-face copying cycles are initiated by the subsequent copy start signal, whereby said displays vary in the order of "15-1", "15-2", . . . , "15-11", "15-12", "15-13", . . . with the progress of copying cycles, and the copy sheets having double-sided images are ejected onto the tray 31 or into the sorter 30.

Said second-face copying mode is terminated when the completed copy number becomes equal to the selected copy number, i.e. when the displays become "15-15".

Thus the copier is automatically shifted to the first-face copying mode, and the displays are shifted from "15-15" to "20-15", indicating a deficiency of 5 copies with respect to the initially selected 20 copies.

The copying cycles for such deficient 5 copies can be initiated by replenishing the exhausted paper feed station with the copy sheets.

The copying cycles in the second first-face copying mode are initiated by the subsequently copy start signal, whereby the displays progressively change in the order of "20-16", "20-17", . . . and the completed copies are introduced into the intermediate tray 17.

Said first-face copying mode is terminated when the completed copy number becomes equal to the selected copy number, i.e. when the displays become "20-20".

Thus the second-face copying mode is enabled, and the displays are changed from "20-20" to "20-15". The second-face copying cycles in the second second-face copying mode are initiated by the subsequent copy start signal, whereby the displays are step increased in the order of "20-16", "20-17", . . . In this manner the copy sheets having double-sided images are ejected from the apparatus.

Said second-face copying cycles are terminated when the completed copy number becomes equal to the selected copy number, i.e. when the displays become "20-20", thus completing all the required copies.

In this manner the copying operation can be conducted in continuation even when the copy sheets are exhausted during the course of the copying operation, and it is to be noted that the present invention is not limited to the manner of displays as explained in the foregoing example. For example at the shift from the first-face copying mode to the second-face copying mode due to the absence of copy sheet in the paper feed station, the displays may be so designed as to change from "20-15" to "20-0" instead of "15-0".

Also at the shift from the second-face copying mode to the first-face copying mode for the second time, the displays may be so designed as to change from "15-15" or from "20-15" in the above-mentioned modified displays to "20-15" or to "5-0".

Finally at the shift from the second first-face copying mode to the second second-face copying mode, the displays may be so designed as to change from "5-5" to "5-0". Furthermore it is naturally possible to employ the subtraction type displays.

As will be apparent from the foregoing (I) and (II), the present embodiment is so structured, when the image forming operation is interrupted before the completion of the image forming cycles of a number selected in advance by the input keys, as to subsequently conduct the image forming operation on the second face of the image bearing members or copy sheets present in the intermediate tray. Such function is extremely advantageous in avoiding unnecessary waiting time since the second-face image formation can be immediately initiated even if the copy sheets are exhausted during the first-face image formation and the replenishment of copy sheets can be made during said second-face image forming operation. (III) In case the "stop" button 45 is actuated during the second-face copying mode, the copying operation is interrupted but the displays for the copy numbers and the double-side copy mode are retained. Thus in response to the subsequent actuation of the copy start button 35, the copying operation is restarted and the number of copies is added to the display prior to the interruption.

On the other hand if the copy sheets are removed from the intermediate tray 17 in such case, the displays and the copying mode are automatically shifted to the first-face copying mode in the same manner as in the first-face copying mode explained in the foregoing.

Such actuation of the "stop" button 45 during the second-face copying operation will be required by the similar reasons as in the interruption of the first-face copying operation, but an automatic shift to the first-face copying mode allowing to select a new copy number will result in a difference between the number of copy sheets present in the intermediate tray 17 and the selected copy number.

For this reason the second-face copying mode is retained until the subsequent copy start signal in case an interruption signal during the second-face copying operation. Consequently the copy sheets already having the image on the first face but not yet subjected to the image formation on the second face are stored as effective copy sheets in the intermediate tray 17.

(IV) In case of a paper jamming detected in the course of first-face copying operation, the function of the apparatus is similar to that in case of single-side copying. Thus, in case said jamming is detected by the detector 36, 37 or 38, the copy sheets presented after the separating station are stored in the intermediate tray 17 after the image fixing step.

On the other hand, in case said jamming is detected by the detector 38 or 39, the copy sheets present after the corresponding detector are advanced into the intermediate tray 17 while those present in front of the corresponding detector have to be removed from the apparatus.

When the copying operation is restarted, the number of copies is added to the displayed copy number at the interruption by jamming.

(V) In case of paper jamming in the course of second-face copying operation, the number of completed copies becomes deficient with respect to the selected copy number as some copy sheets have to be removed due to paper jamming.

The double-side copier of the present embodiment is designed to resolve such deficiency. After the jam state is eliminated, the copying operation is continued on all the copy sheets remaining in the intermediate tray 17, and, upon completion thereof, the apparatus returns automatically to the first-face copying mode while displaying the number of completed double-sided copies and the initially selected copy number and lights the lamp PL9 to show a message requesting the original for the first face, thus enabling the copying cycles for the deficient copies.

Upon subsequent actuation of the copy start button 35 there is again started the first-face copying operation, which is terminated when the displayed number of completed copies is added with the number of newly obtained copies and becomes equal to the selected copy number, whereupon the second-face copying mode is enabled to light the lamp PL10 for a message requesting the original for the second face and to display the completed copy number and the selected copy number same as those displayed prior to the abovementioned first-face copying operation for the second time.

Upon subsequent actuation of the copy start button, there is started the second-face copying operation, which is terminated when the displayed number of completed copies is added with the number of newly obtained copies and becomes equal to the selected copy number, whereby the entire copying operation is completed and the apparatus awaits the next double-side copying.

At the above-mentioned first-face copying mode of the second time and at the automatic shift to the second-face copying mode, the initially selected conditions with respect to the image magnification, density and copy outlet are automatically restored from the memory in the apparatus.

Also in case said deficient copies are no longer needed, the automatically selected first-face copying mode mentioned above can be cancelled by the actuation of a clear key. In this state any other copying mode can be freely selected as the intermediate tray 17 contains no copy sheet. In addition to the foregoing procedure, the deficiency in the number of copies resulting from the paper jamming in the course of second-face copying operation can be compensated in the following manner. After the paper jamming is resolved, the second-face copying operation is continued on all the copy sheets remaining in the intermediate tray 17 in the same manner as explained in the foregoing, and, upon completion thereof, the apparatus returns to the first-face copying mode, giving the message requesting the original for the first-face copying and giving the number of deficient copies as a newly selected copy number. In this case the copy modes initially selected for the first-face copying operation are automatically restored at the second first-face operation are from the memory in the apparatus.

In case of subtraction type display, the number of deficient copies is direct-y indicated by the display of uncompleted copy number obtained at the end of second-face copying operation on all the copy sheets remaining in the intermediate tray, so that the apparatus simply returns to the first-face copying mode with the message requesting the original for the first-face copying but without change in the display, and restores the copying modes initially selected for the first-face copying.

Also in case the sorter 30 is used in combination with the double-side copying operation, the newly obtained copies for filling the deficiency are sorted in the sorter 30 starting from a bin succeeding to the last bin having received the completed copy before the interruption by the paper jamming.

(VI) If plural copy sheets are supplied simultaneously during the first-face copying operation, the number of copy sheets present in the intermediate tray becomes larger than the selected copy number. As the second-face copying cycle in the present embodiment is repeated until the copy sheets in the intermediate tray are exhausted, the completed copy number shown in the lower display unit becomes larger than the selected copy number displayed in the upper display unit.

Such second-face copying cycle applied on all the copy sheets present in the intermediate tray regardless of the copy number selected by the input keys ensures to obtain the copies having images on both faces in a preselected number, even in the presence of doubly supplied sheets in the first-face copying operation, though such doubled paper supply results in surplus copy sheets lacking the image on the first face.

(VII) In case of doubled paper supply during the course of the second-face copying mode, the completed copy number becomes less than the selected copy number. In the present embodiment, as will be apparent from the foregoing items (V) and (VI), the apparatus automatically returns to the first-face copying mode after the completion of the second-face copying operation if the number of copy sheets having images on both faces does not reach the copy number selected by the input keys.

In this manner the copies are always obtained exactly in the desired number, and the copying conditions with respect to the magnification, image density etc. at the initial first-face copying mode are automatically restored in the second first-face copying mode without repeated mode setting by the operator.

(VIII) In the rare case in which the power supply to the apparatus is interrupted by the power failure or by the error during the first- or second-face copying operation in the double-side copy mode, all the memories prior to such power interruption are erased and the apparatus assumes the standard mode upon restoration of the power supply. Thus, if the operator selects again the double-side copying mode while the intermediate tray 17 contains the copy sheets, the lamp PL11 lighted to display a message requesting the removal of the copy sheets in the tray 17, and the copying operation is disabled until such removal is completed.

On the other hand, if the operator selects the single-side copy mode, the copying operation is enabled without such removal, as the presence of copy sheets in the intermediate tray 17 does not prohibit the single-side copying operation. In case said copy sheets in the tray 17 are those having the appropriate image on the first face thereof, it is possible to obtain copies with double-sided images by transferring said copy sheets to the first of second paper feed station manually and conducting the single-side copying operation on the second face of said copy sheets.

As explained in the foregoing the tranfer to the first-face copying mode in the double-side copy mode is disabled in case the copy sheets are present in the intermediate tray.

(IX) The copier of present embodiment is provided with a cut-in or interruption copying function.

Such interruption copying can be made as single-sided or double-sided during a single-side copying operation as the intermediate tray 17 is not in use. Upon actuation of an "interruption" button during the single-side copying operation, the copying operation is immediately interrupted and the copy mode returns automatically to the standard mode, while the copy modes prior to the interruption are all stored in the apparatus. Also during a double-side copying operation, in which the intermediate tray is in use, only a single-side cut-in is accepted. Thus, upon actuation of the interruption button during a double-side copying operation, the copying operation is immediately interrupted and the copy mode returns automatically to the standard mode in the same manner as in the foregoing. The interruption copying can also executed with any mode or any selected copy number modified from said standard mode, except that the selection of double-side copy mode is prohibited during a double-side copying operation.

Upon completion of the interruption copying, the memorized copy modes are automatically restored to restart the interrupted copying operation upon the actuation of the copy start button.

Now there will be given an explanation on the control circuit shown in FIGS. 3 and 4.

Figure 3:
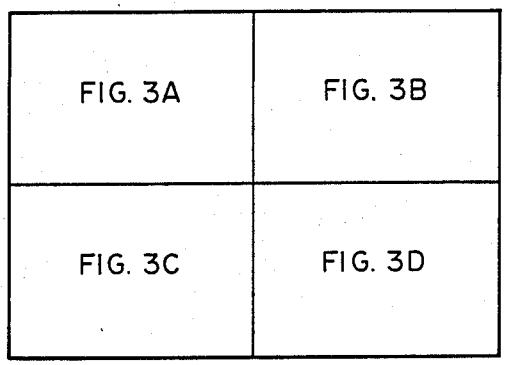
FIGS. 3, which is a composite of FIGS. 3A–3D, and 4 are diagrams of the control circuit for the copier shown in FIG. 1.
Figure 4:
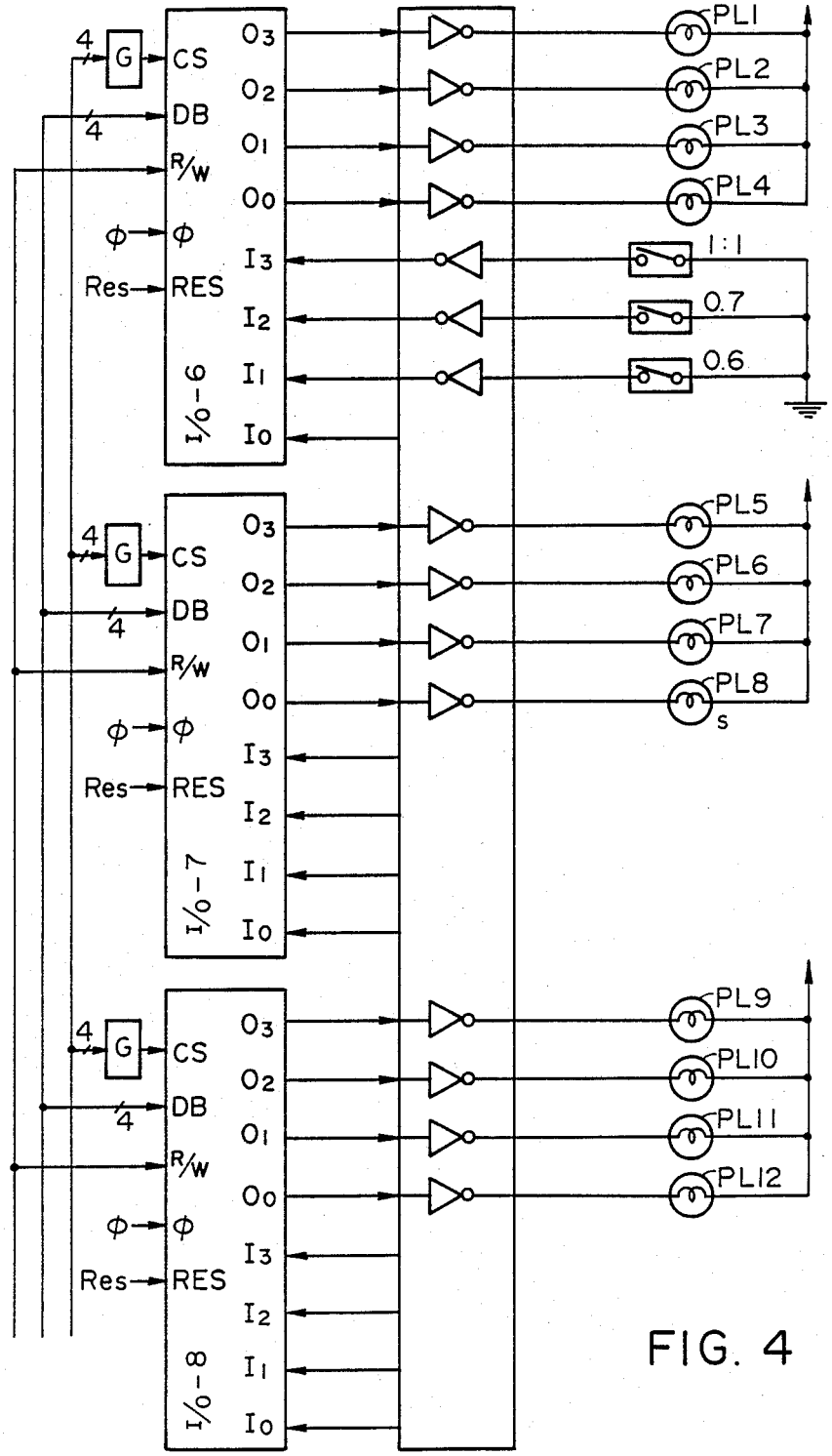
Figure 5B:
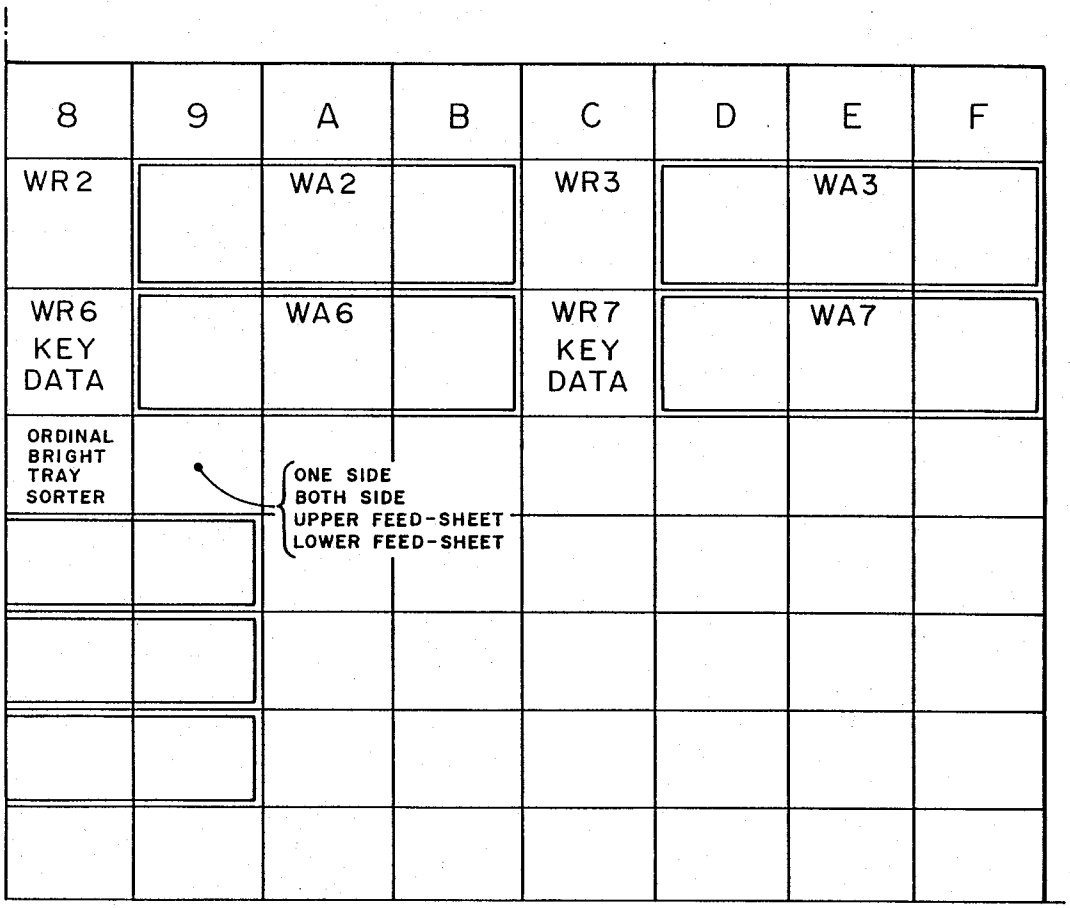
Figure 6A:
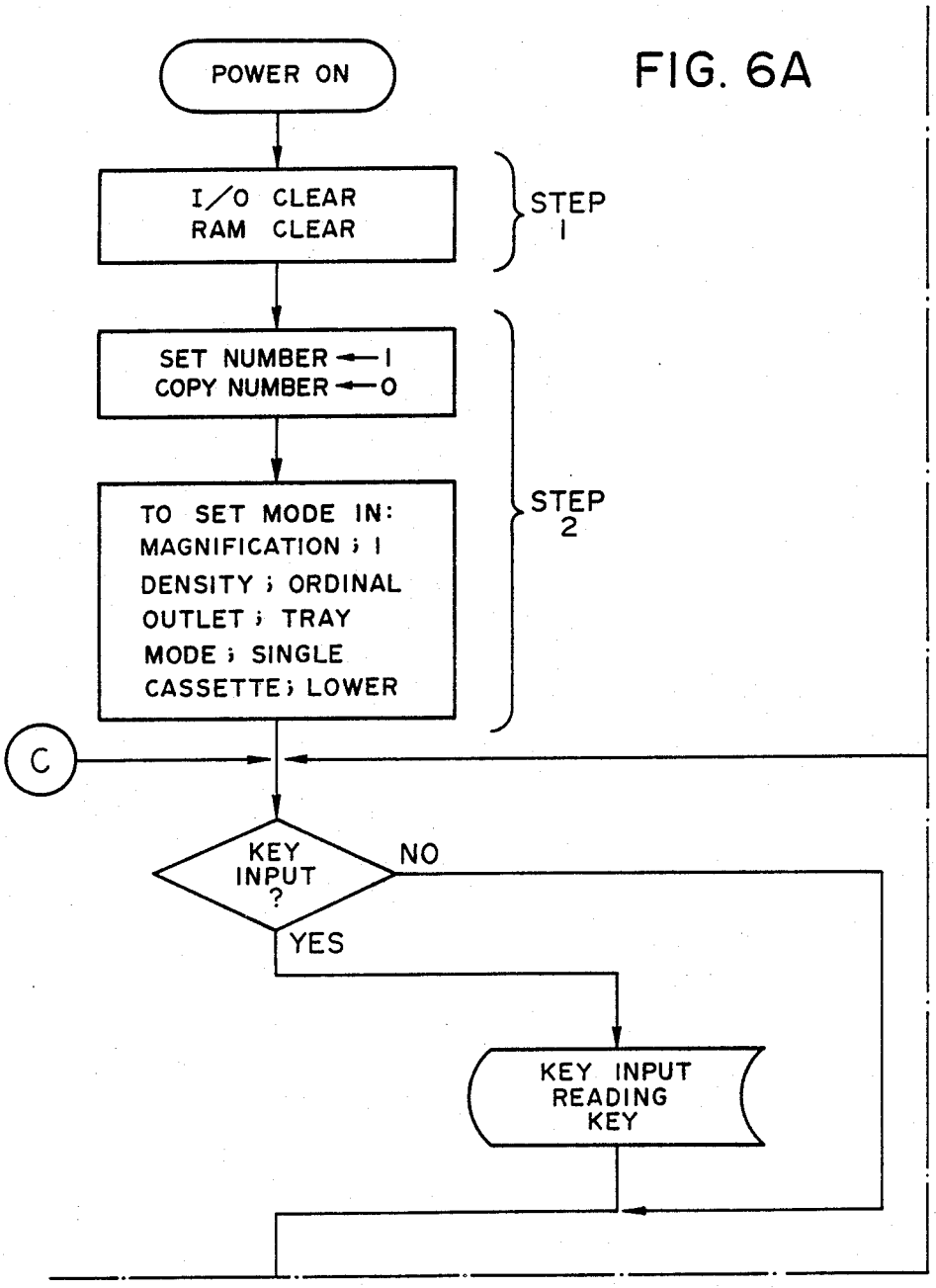
Figure 6B:
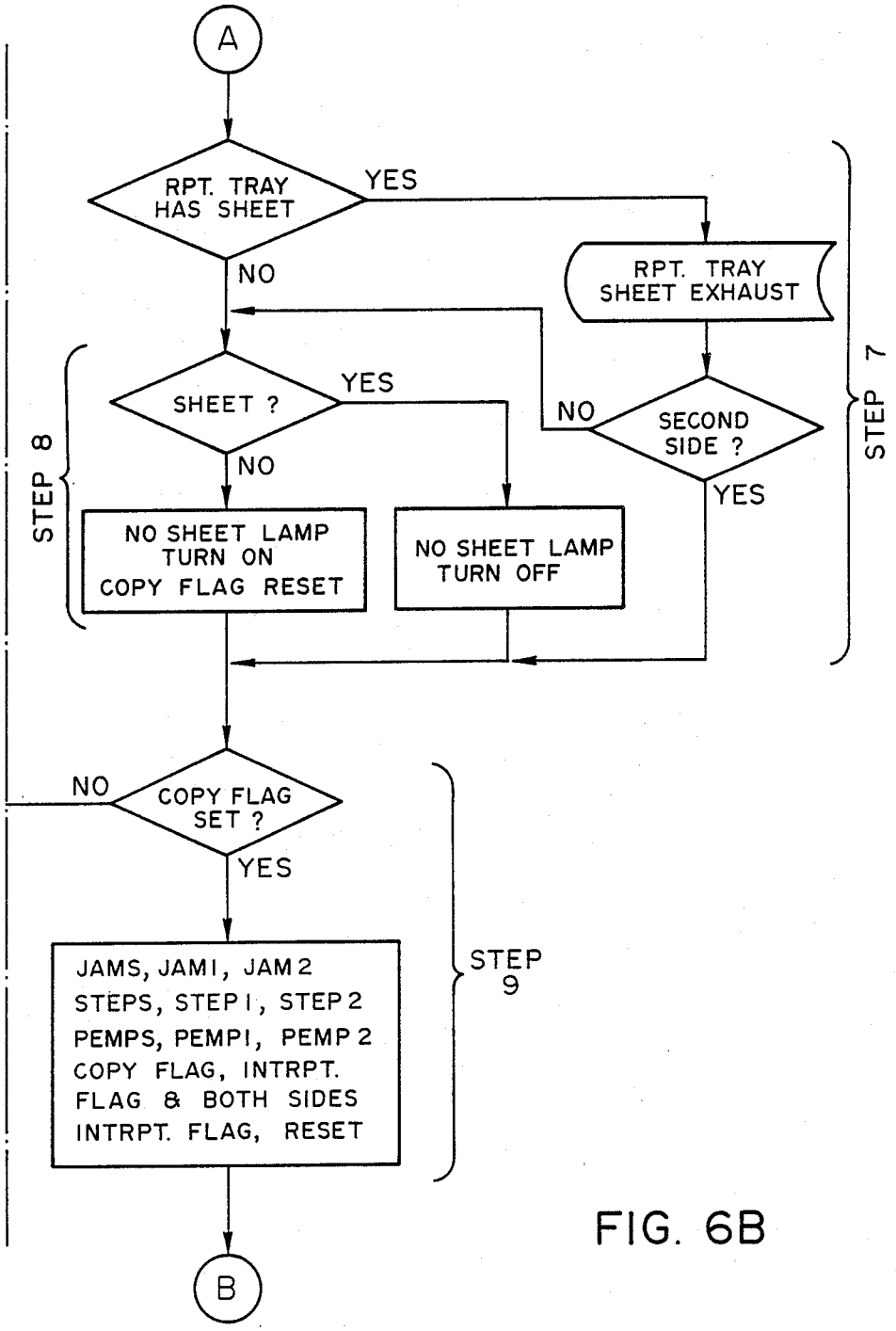
Figure 6C:
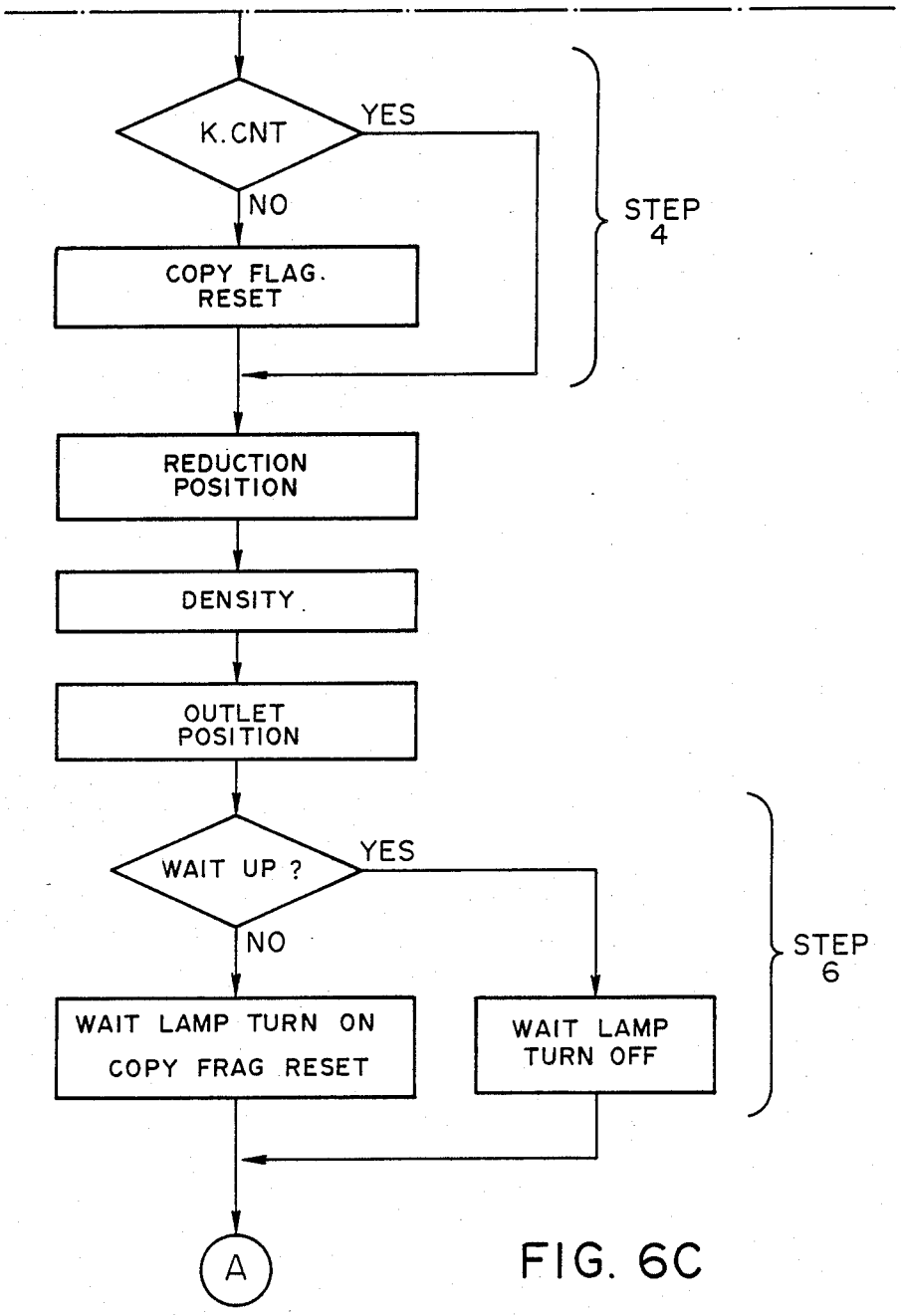
Figure 7A:
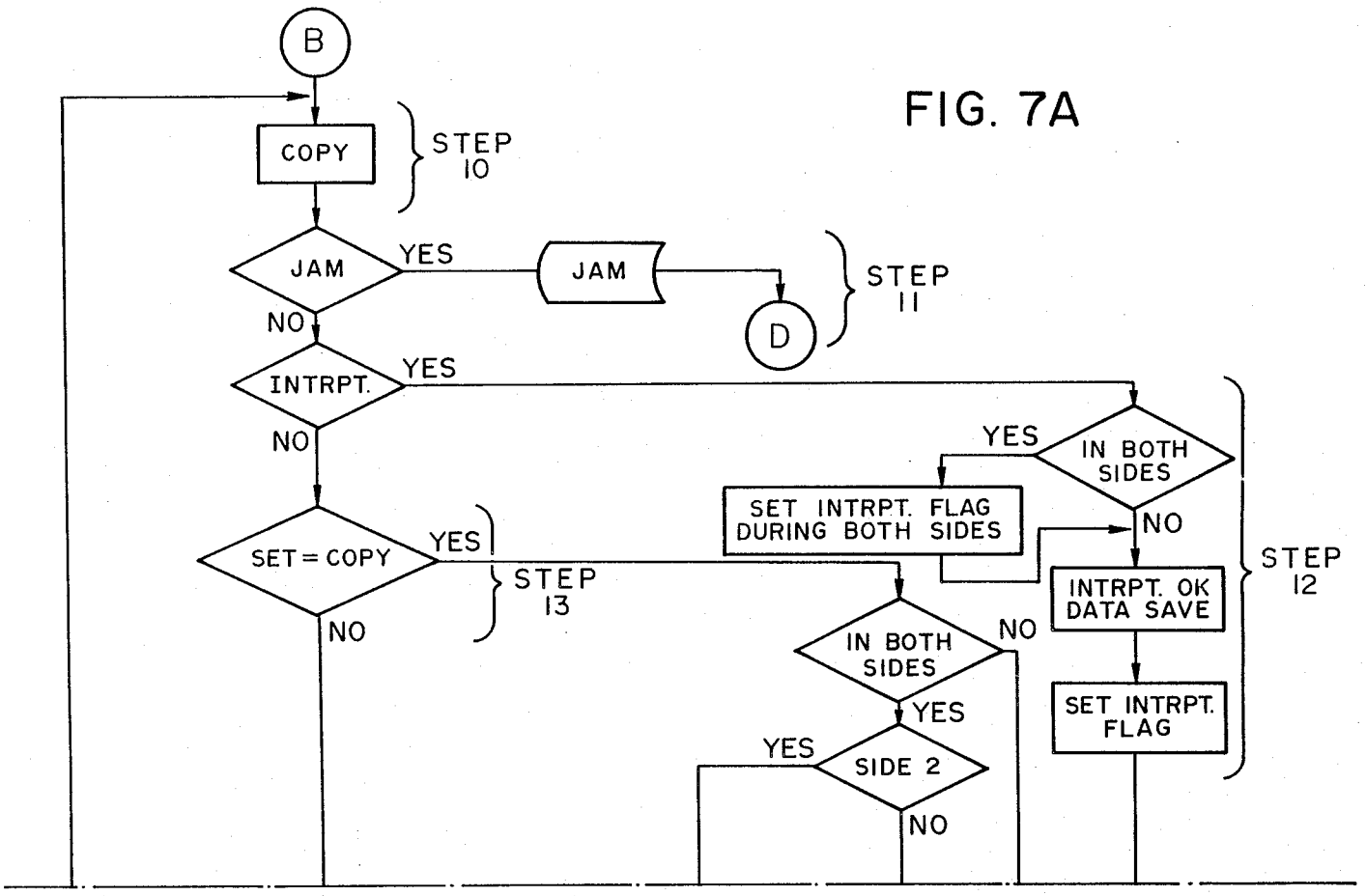
Figure 7B:
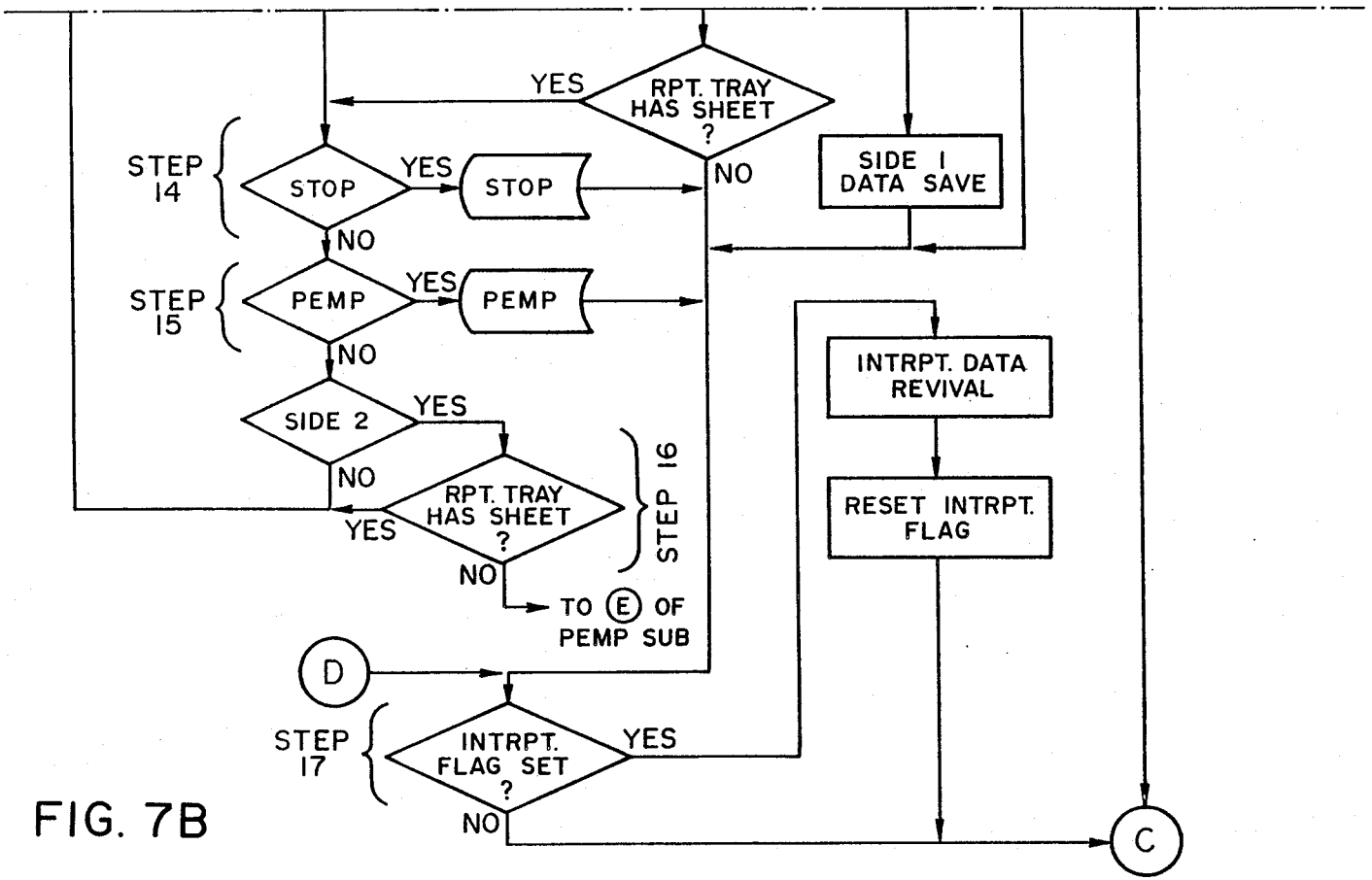
Figure 8A:
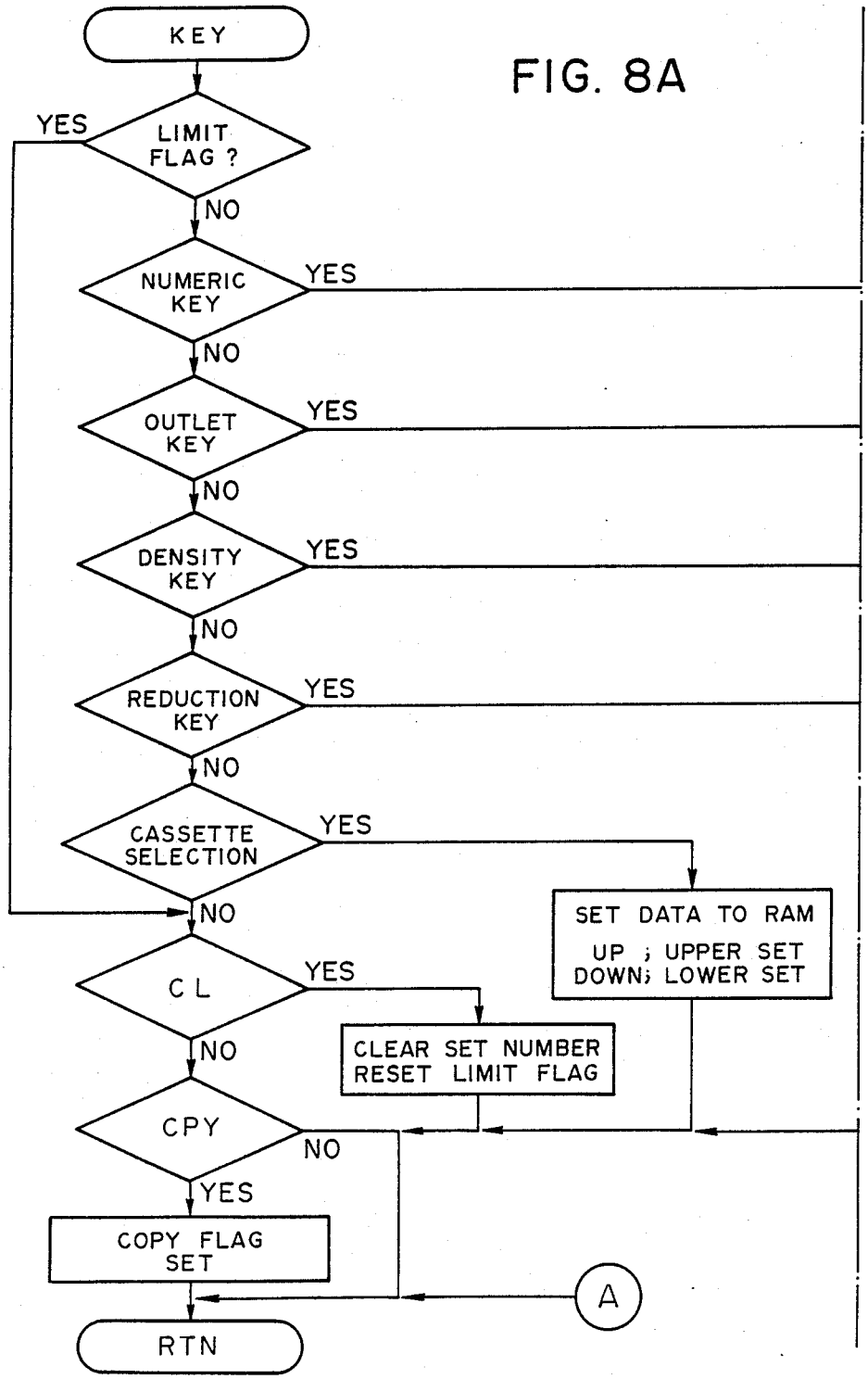
Figure 8B:
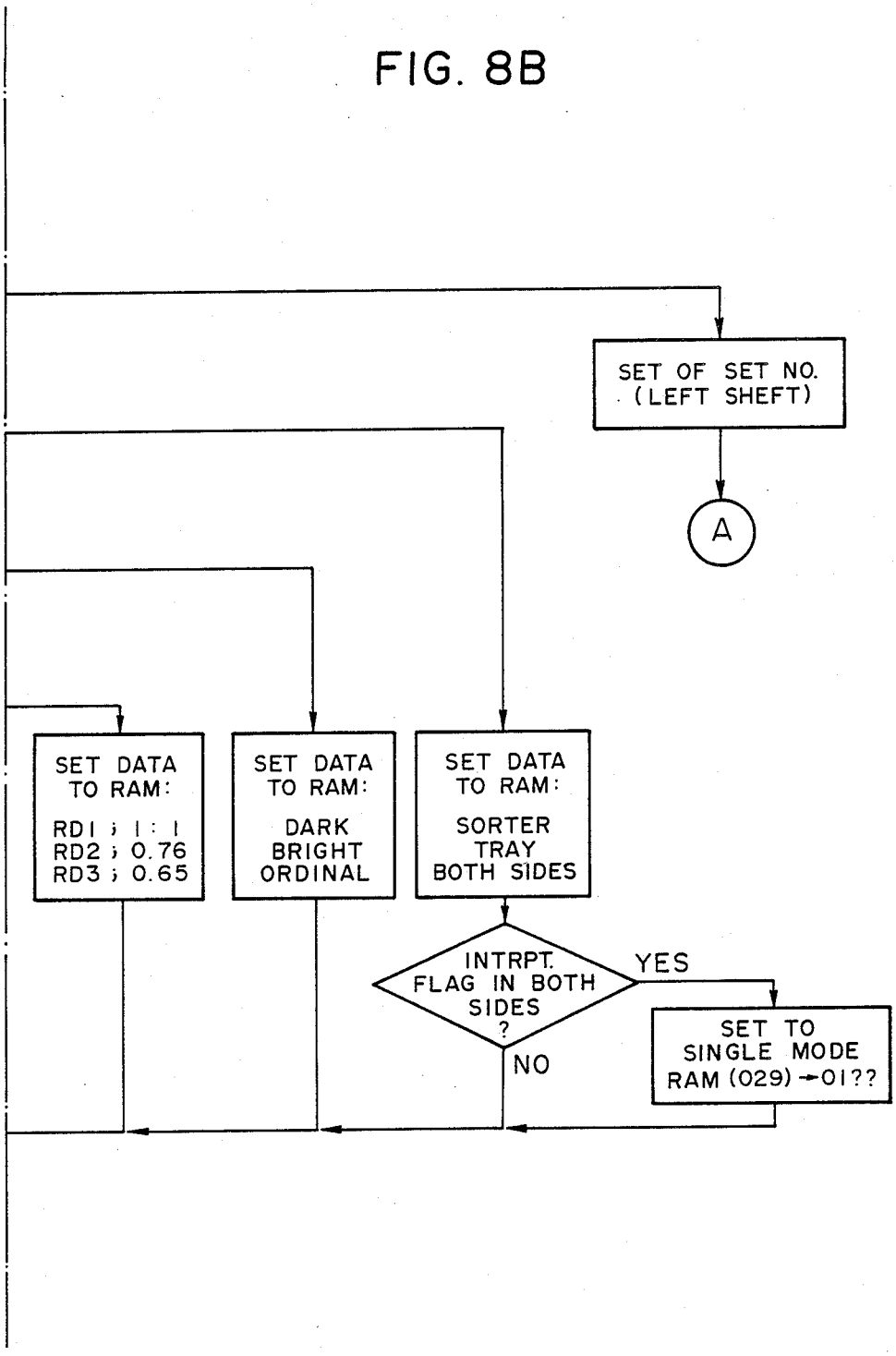
Figure 9:
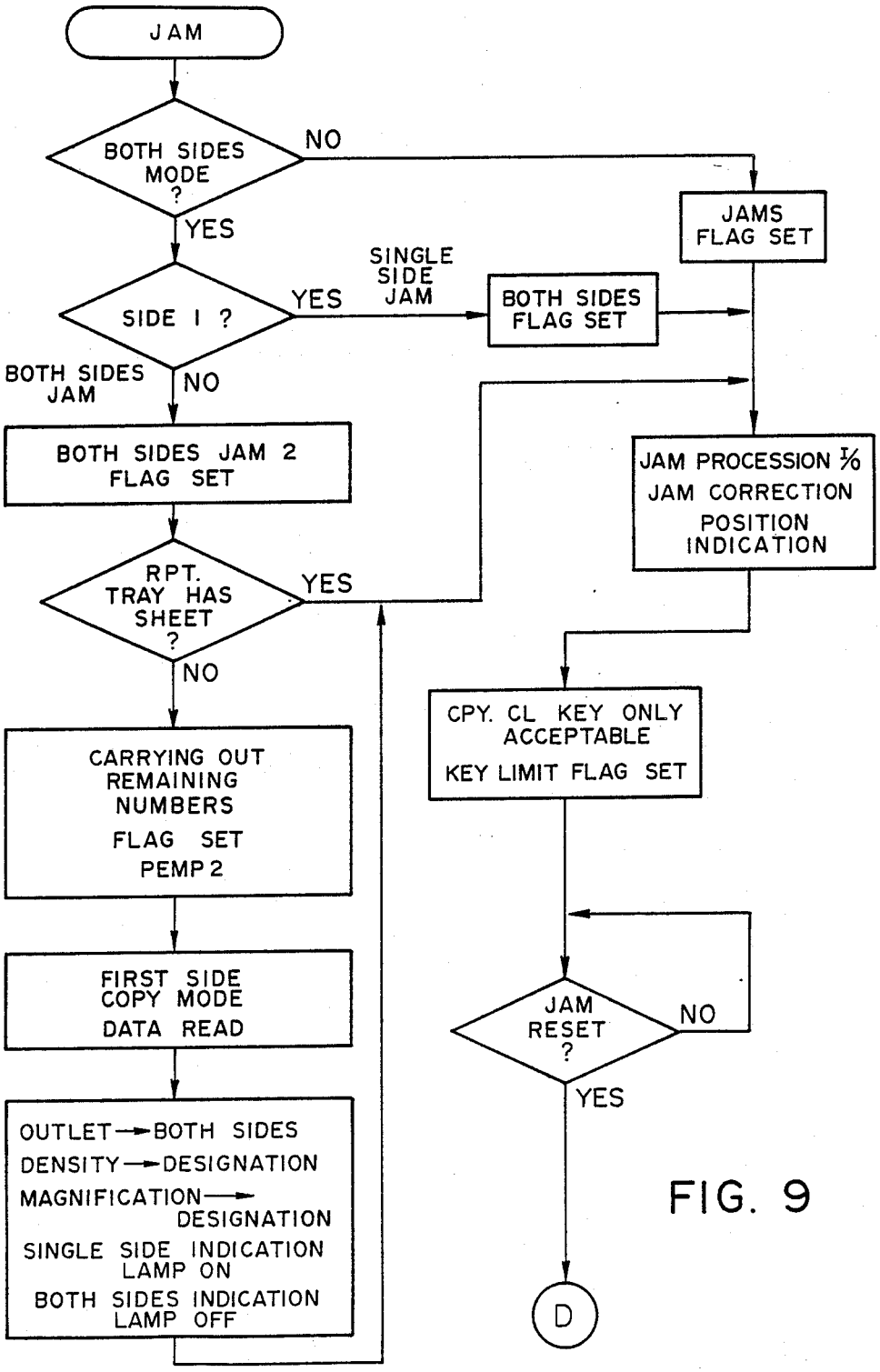
FIGS. 9–14 are also subroutines of the program illustrated by FIGS. 6 and 7.

Referring to FIG. 3, a 4-bit parallel microprocessor CPU is provided with a random-access memory RAM of 256×4 bits, a program read-only memory ROM of 4K×8 bits, and 4-bit input/output devices I/01–I/08, including an input/output device I/05 exclusively for the key switches and 7-segment display, for example composed of μpD757 supplied by NEC Company. Said input/output devices are connected to various loads through known drivers and input interfaces.

The sequence control of the apparatus is achieved by the program stored in said ROM.

Figure 7:
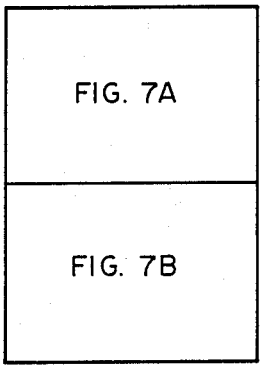
FIGS. 6 and 7, which are composites, respectively, of FIGS. 6A–6D and FIGS. 7A and 7B, are general flow charts of the programs utilized in conjunction with the apparatus of the invention.
Figure 6:
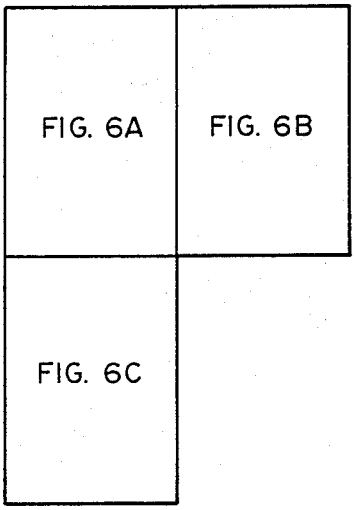
Figure 8:
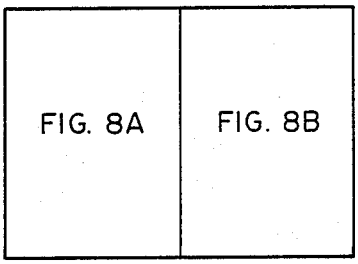
FIG. 8, which is a composite of FIGS. 8A and 8B, is a subroutine of the program illustrated by the flow charts of FIGS. 6 and 7.
Figure 2A:
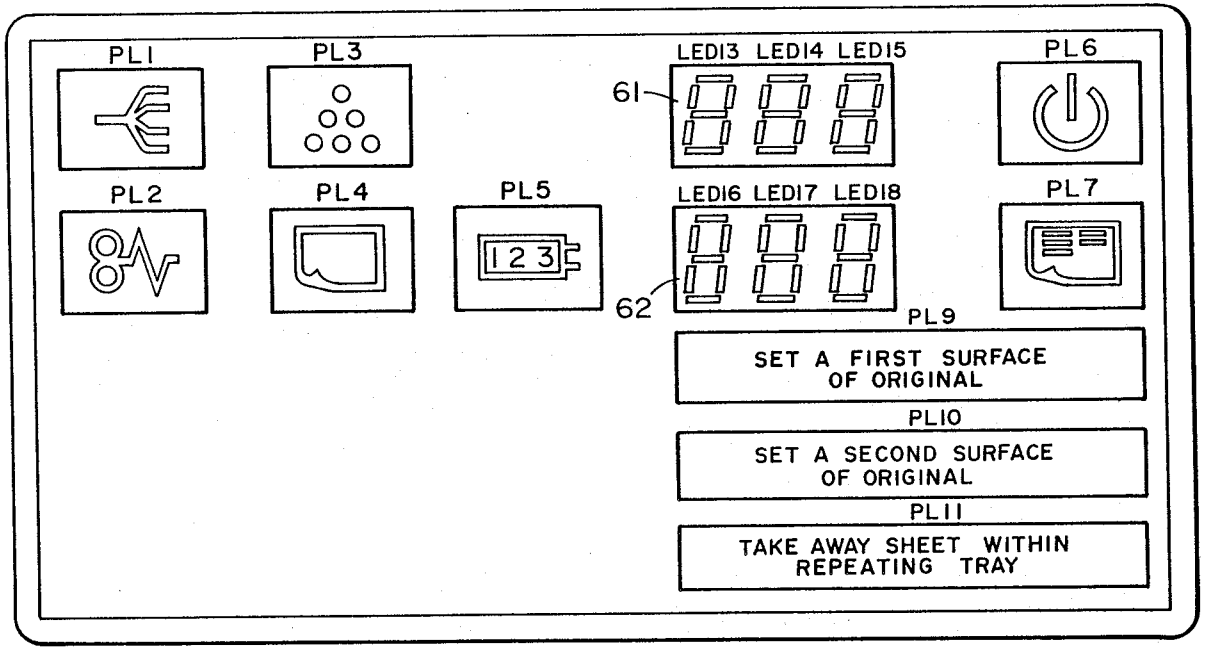
Figure 2B:
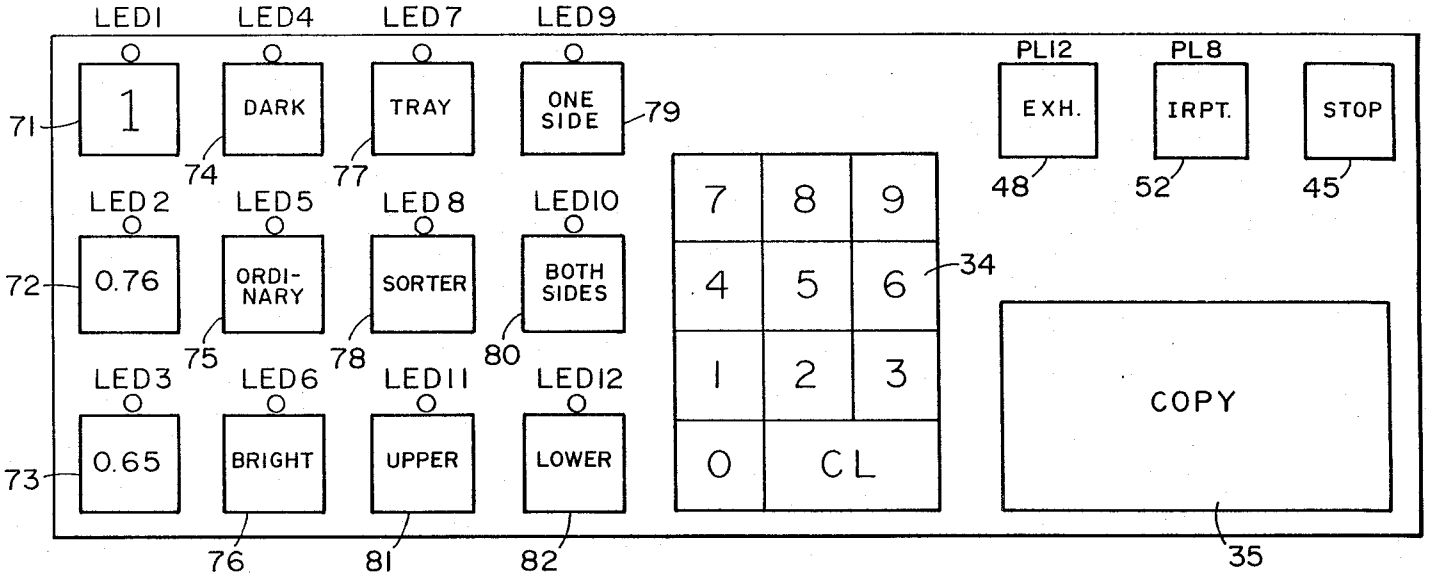
Figure 3A:
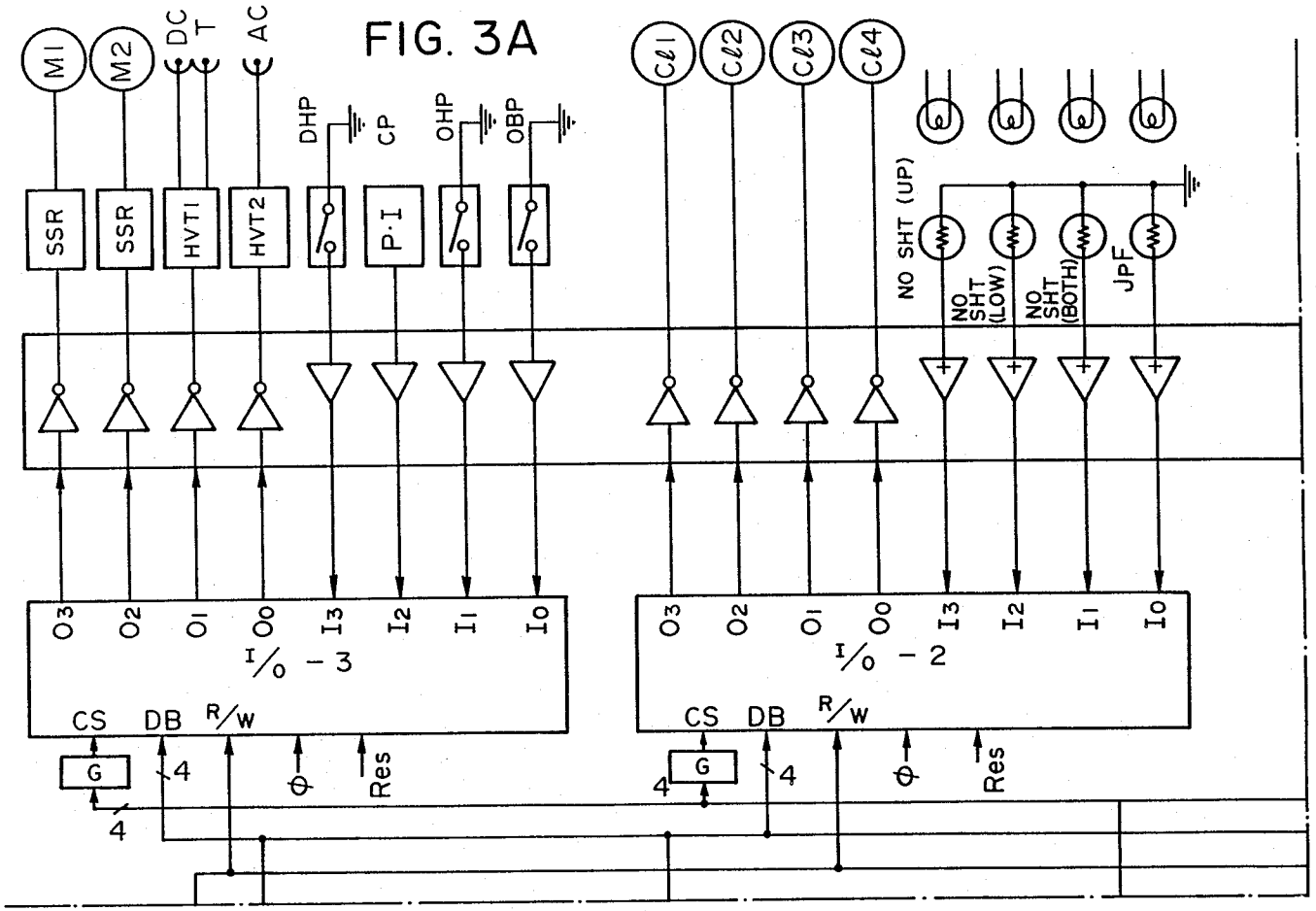
Figure 3B:
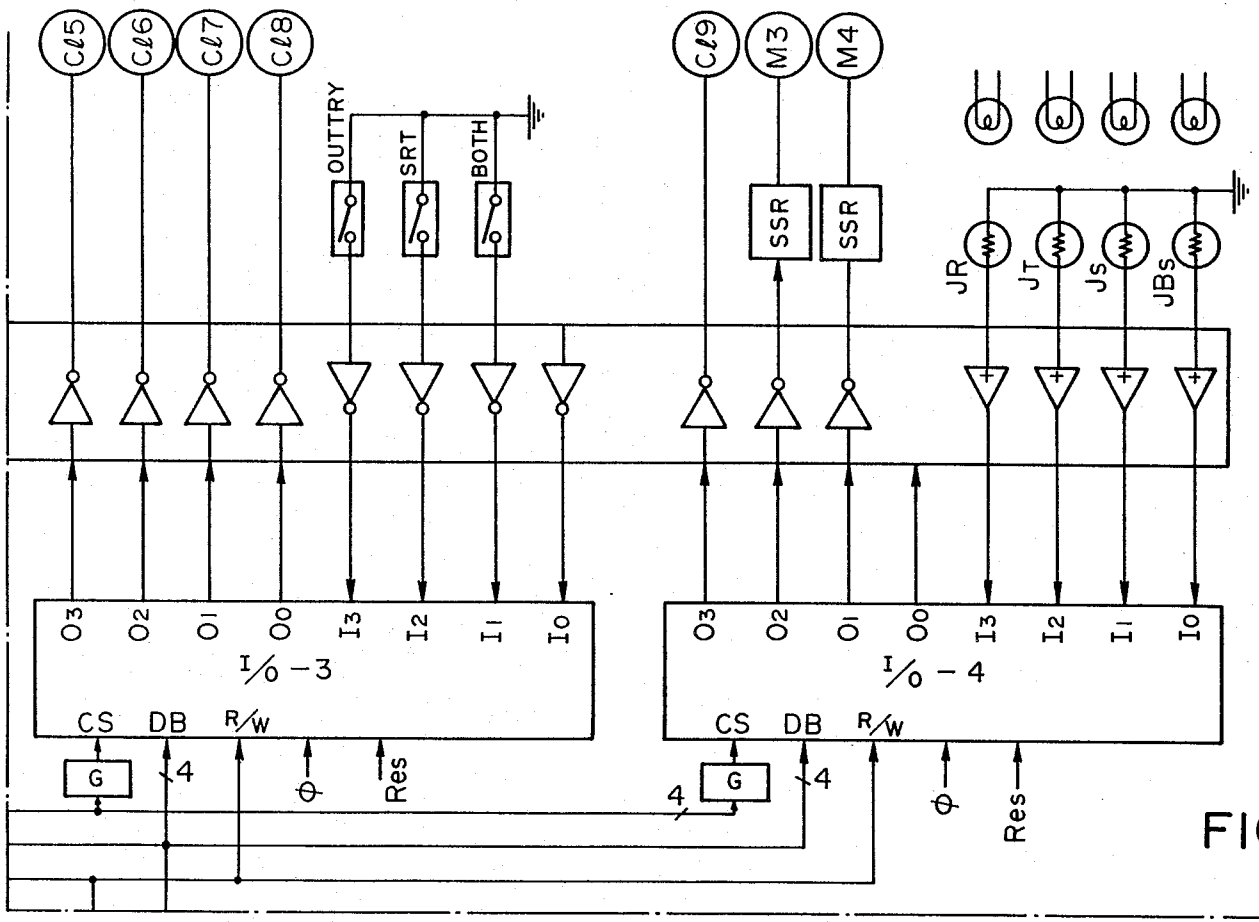
Figure 3C:
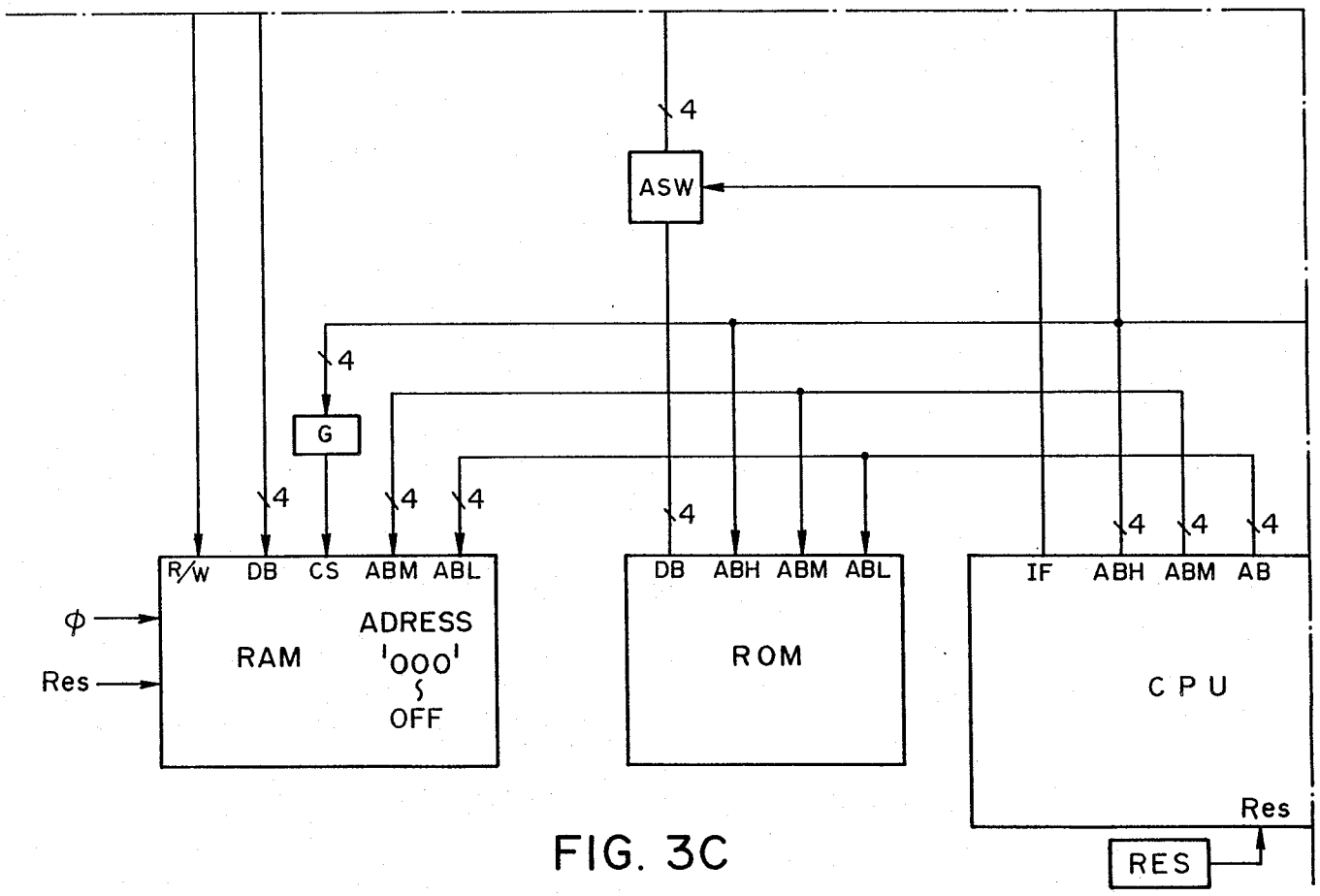
Figure 3D:
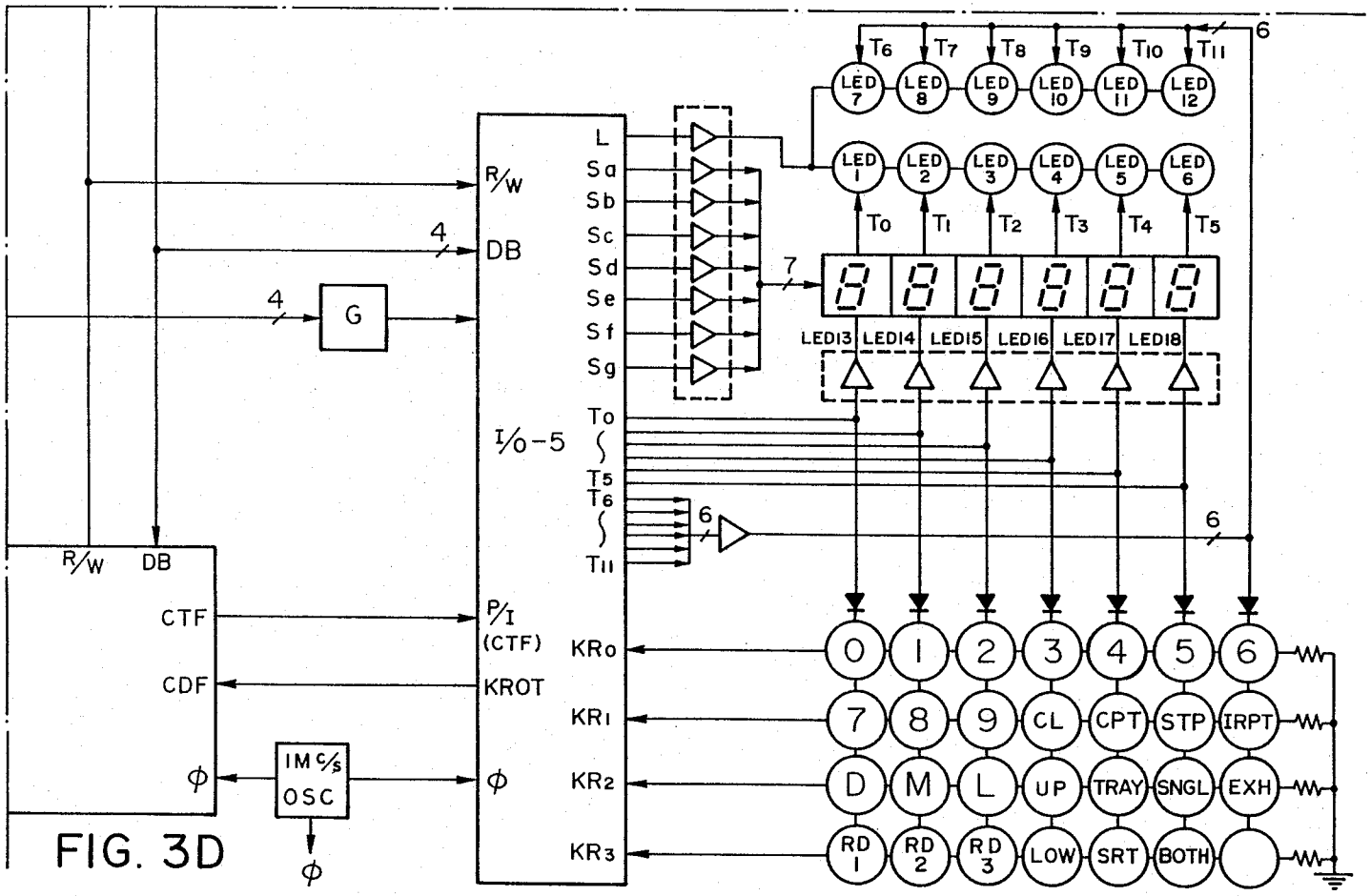

FIGS. 6 and 7 show the general flow of said program, while FIGS. 8 to 14 show the subroutines thereof.

Now referring to these flow charts, upon closing of unrepresented main switch, the CPU initiates function from the program address '000'.

At first in the step 1, the CPU clears all the RAM addresses "000"-"OFF", and also clears all the output ports, thus turning off all the process loads.

Figure 5:
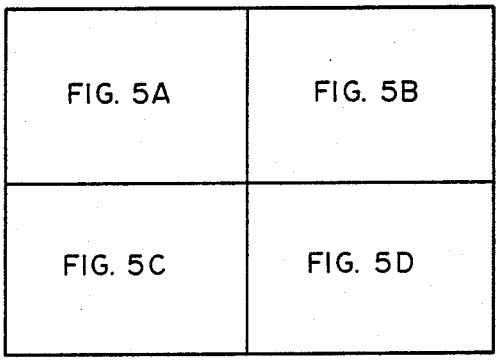
FIG. 5 is a composite of FIGS. 5A–5D which show a memory domain chart of the random access memory shown in FIG. 3.

In the step 2, the CPU stores data CNT1=001 and CNT2=000 in the corresponding addresses, as shown in RAM map in FIG. 5, respectively for the selected copy number and the completed copy number. Then the date for the standard mode, i.e. "024"=0, "025"=2 (for lighting the original exchange lamp), "026"=0, "027"=8 (for indicating 1:1 magnification), "028"=A (for indicating normal density and tray lamp), and "029"=1 (for indicating lower cassette) are stored in the RAM as shown in FIG. 5, and the data stored in the RAM are released through the I/O devices.

The step 3 identifies the presence of key inputs, and executes the key subroutine to store the data in the RAM corresponding to the key inputs.

The step 4 identifies the presence or absence of key counter, and, in case of presence, proceeds to the next step but, in case of absence, resets the copy flag which may have been set by the eventual actuation of the copy start key in the step 3, thus preventing premature start of the copy sequence.

The step 5 executes, according to the content of RAM set in the steps 2 and 3, the reduction subroutine for adjusting the copier to the selected reduction ratio, the density subroutine for adjusting the image density and the outlet routine in the similar manner.

The step 6 identifies whether the fixing heater is already heated, and, if the fixing temperature is not reached, lights the waiting lamp and resets the copy flag for disabling the copy sequence. If the fixing temperature is already reached, the waiting lamp is extinguished and the program proceeds to the next step.

The step 7 identifies the presence of copy sheets in the intermediate tray and executes the paper eject subroutine from the intermediate tray (FIG. 14), which is effective only in the single-side copy mode.

The step 8 identifies the presence or absence of copy sheets in the selected cassette, and turns on the warning lamp indicating absence of paper and resets the copy flag in case of the absence.

The step 9 identifies the presence of copy flag, and, in case of presence, resets necessary flags and proceeds to the copy sequence. In case of absence of copy flag the program returns to the step 3 and repeats the "stand-by" routine of the steps 3 to 9.

The copy routine starts from the step 10.

The step 10 initiates the copy sequence, according to the settings made in the stand-by routine and in response to the actuation of the copy start button, by activating the main motor and repeating the steps of exposure, charging development, paper feed etc. The following steps for the identification of paper jamming, interruption signal, completion of selected copy number, stop signal, no-paper signal etc. are once or plural times inserted in the repeated process loop for executing respective subroutine in case signals are identified, as will be explained in the following in relation to FIGS. 9, 10, 11 and 7.

Referring to FIG. 7, the program proceeds to the jam subroutine in case a jam is identified in the step 11. Also it proceeds, in response to the actuation of the interruption key, to the step 12, which sets an interruption flag during double-side copy mode (RAM address 07C) in case of an interruption during a double-side copy mode. Upon enabling such interruption in the step 12, the data for copy modes, completed copy number and selected copy number for the interrupted copying operation are memorized by transfer from CNT1 to CNT4, CNT2 to CNT5 and RAM addresses "024"-"029" to "054"-"059", and an interruption start flag is set in the RAM address "079". Subsequently the program returns to the stand-by routine in which the key input is enabled for the selection of copy modes and of the copy number, thus enabling the copy operation in the interruption mode. In the absence of such interruption the program proceeds to the step 13.

The step 13 identifies the coincidence of the completed copy number with the selected copy number, and, in case of the first-face copying in the double-side copy mode, stores the data for said first-face copying in the RAM addresses "034"-"039"for the repeated first-face copying eventually needed in case of paper jamming in the course of second-face copying.

Also in the second-face copying in the double-side copy mode, the step 13 instructs the continuation of copying cycles until the copy sheets present in the intermediate tray are exhausted even after the completed copy number becomes equal to the selected copy number, since the number of copy sheets in said tray may be in excess of the selected copy number due to the supply of plural sheets at a time in the first-face copying.

Figure 10:
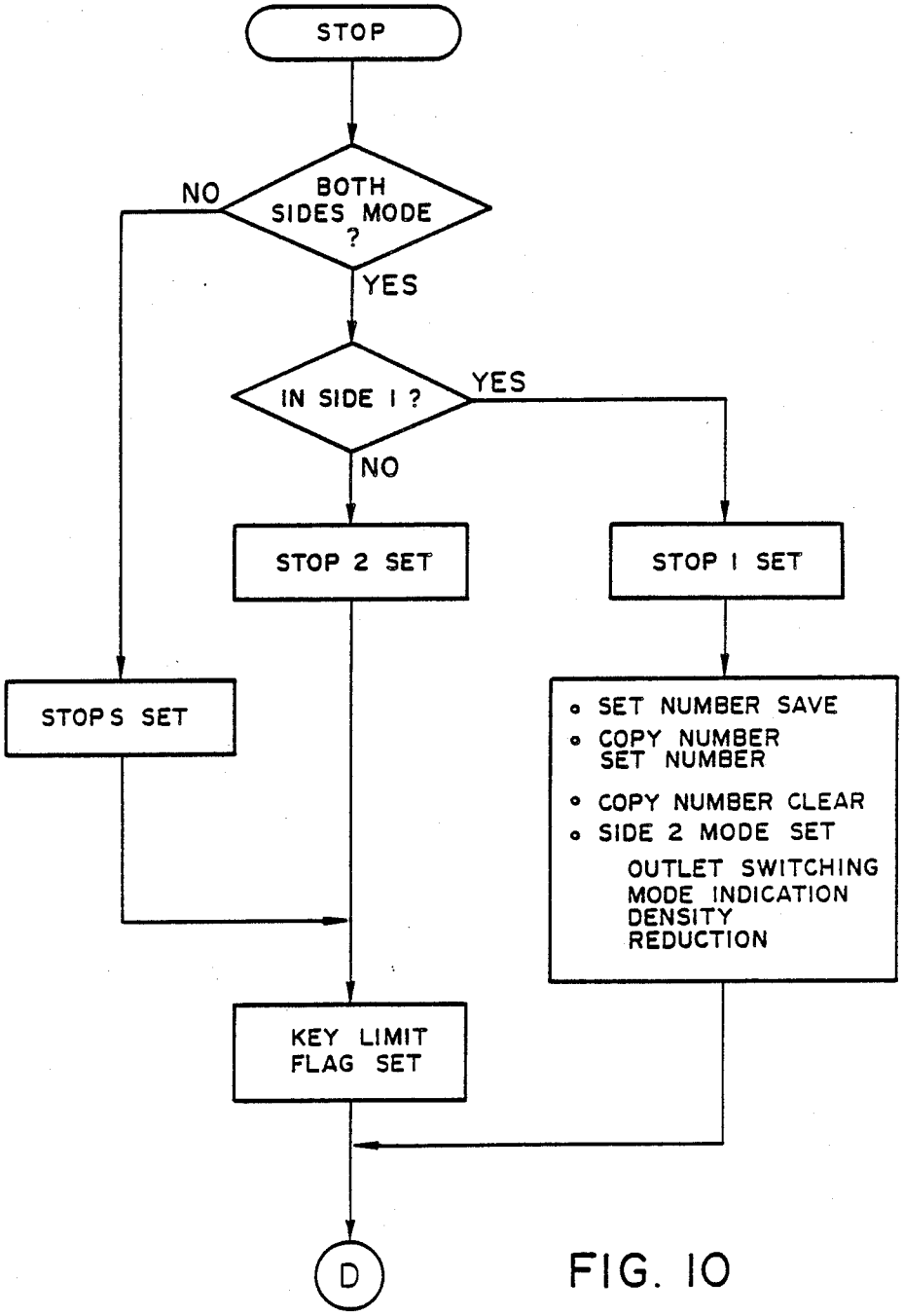

The step 14 identifies the actuation of the stop key, and executes the STOP subroutine as will be explained later in relation to FIG. 10.

The step 15 identifies the presence or absence of copy sheet in the cassette, and, in case of absence, executes the PEMP subroutine as will be explained later in the relation to FIG. 11.

Figure 11:
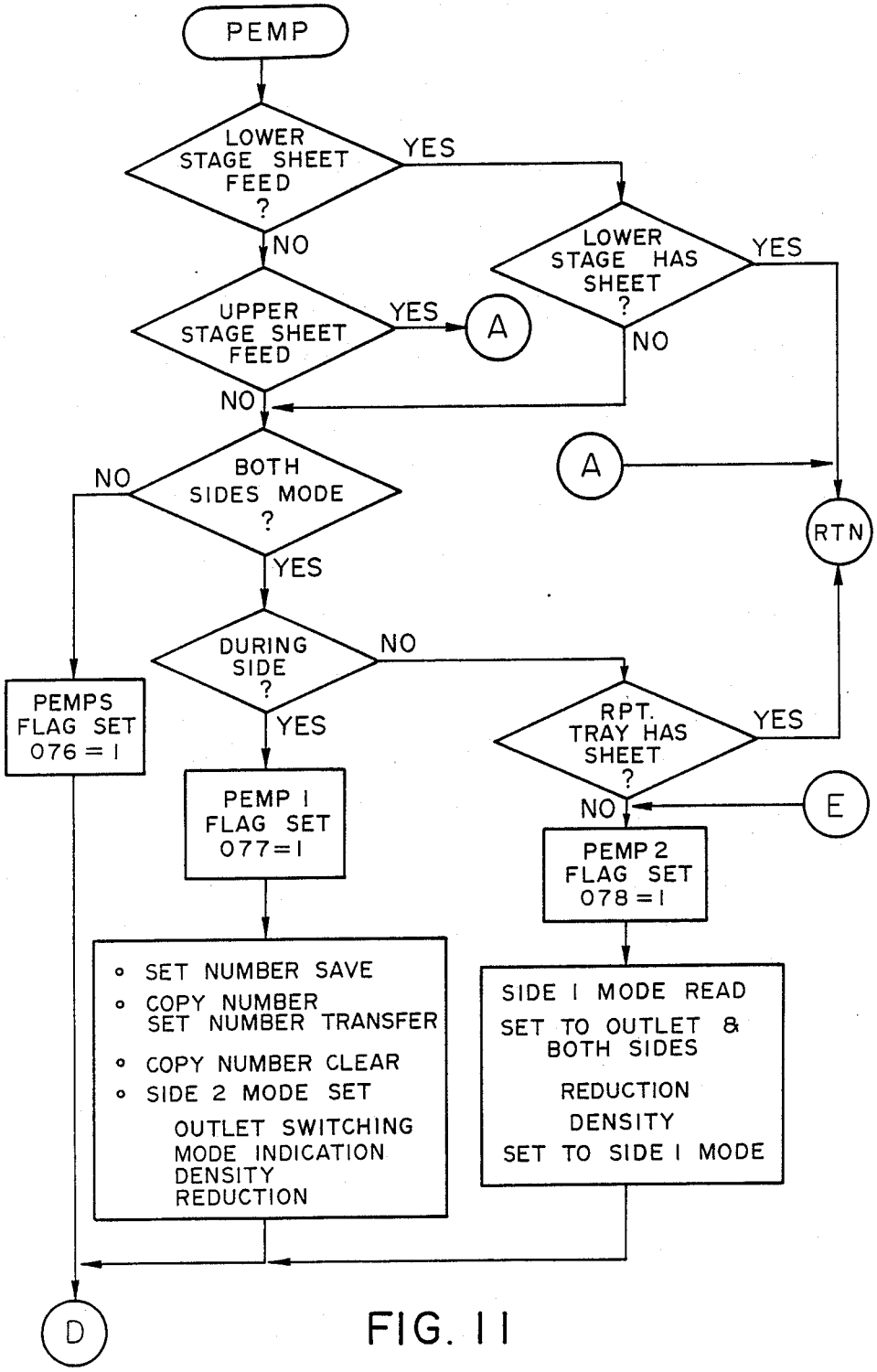
Figure 12:
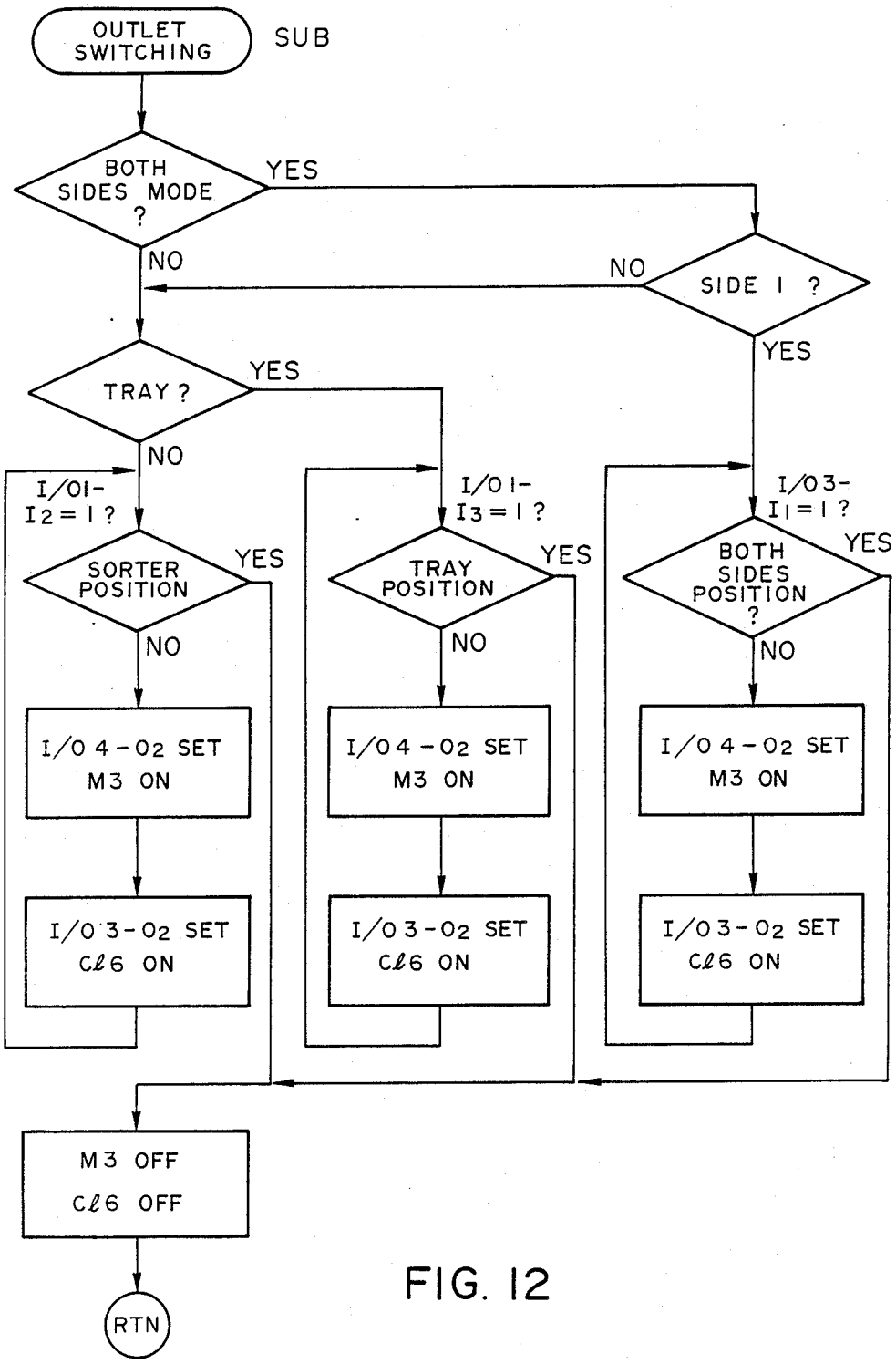
Figure 13:
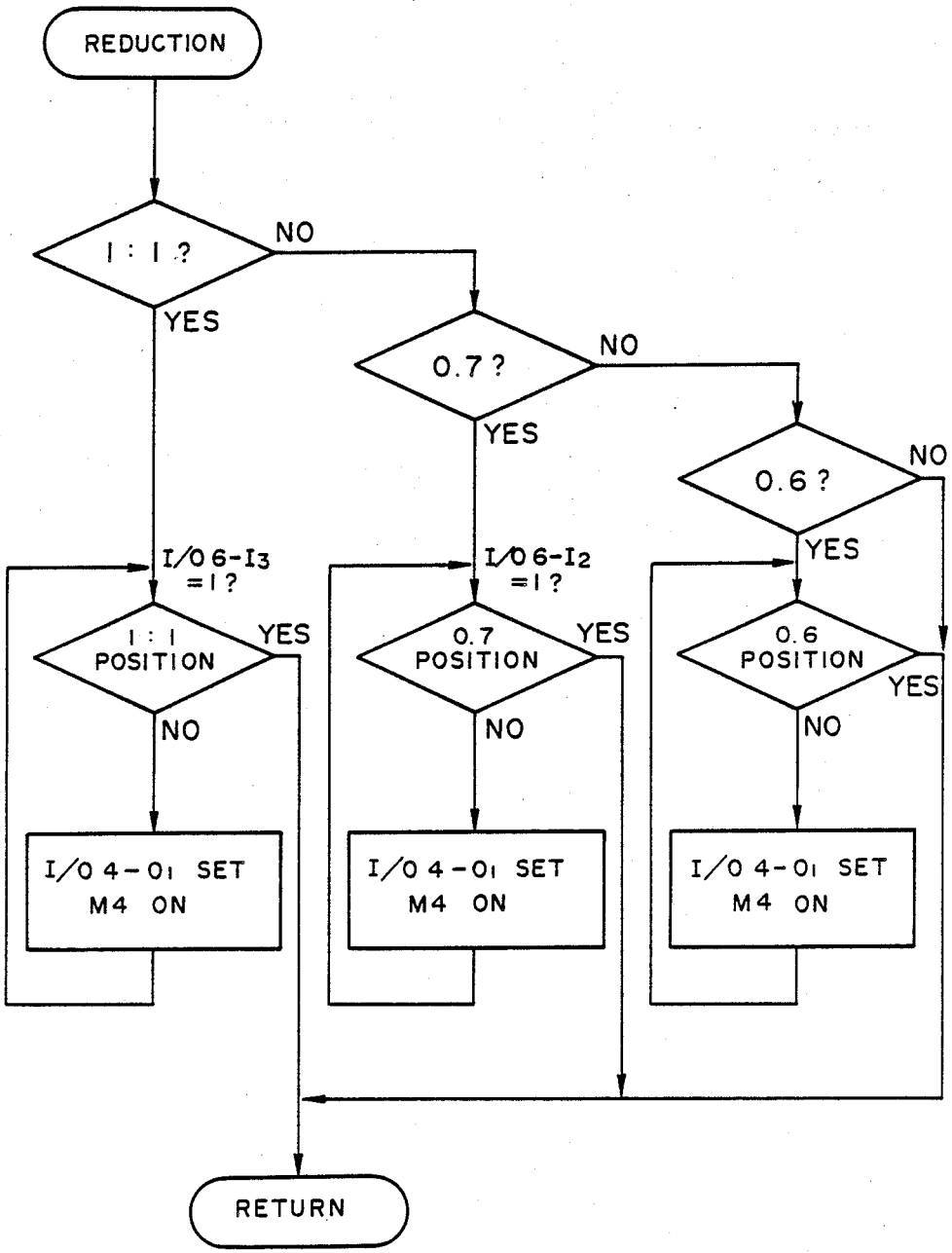
Figure 14:
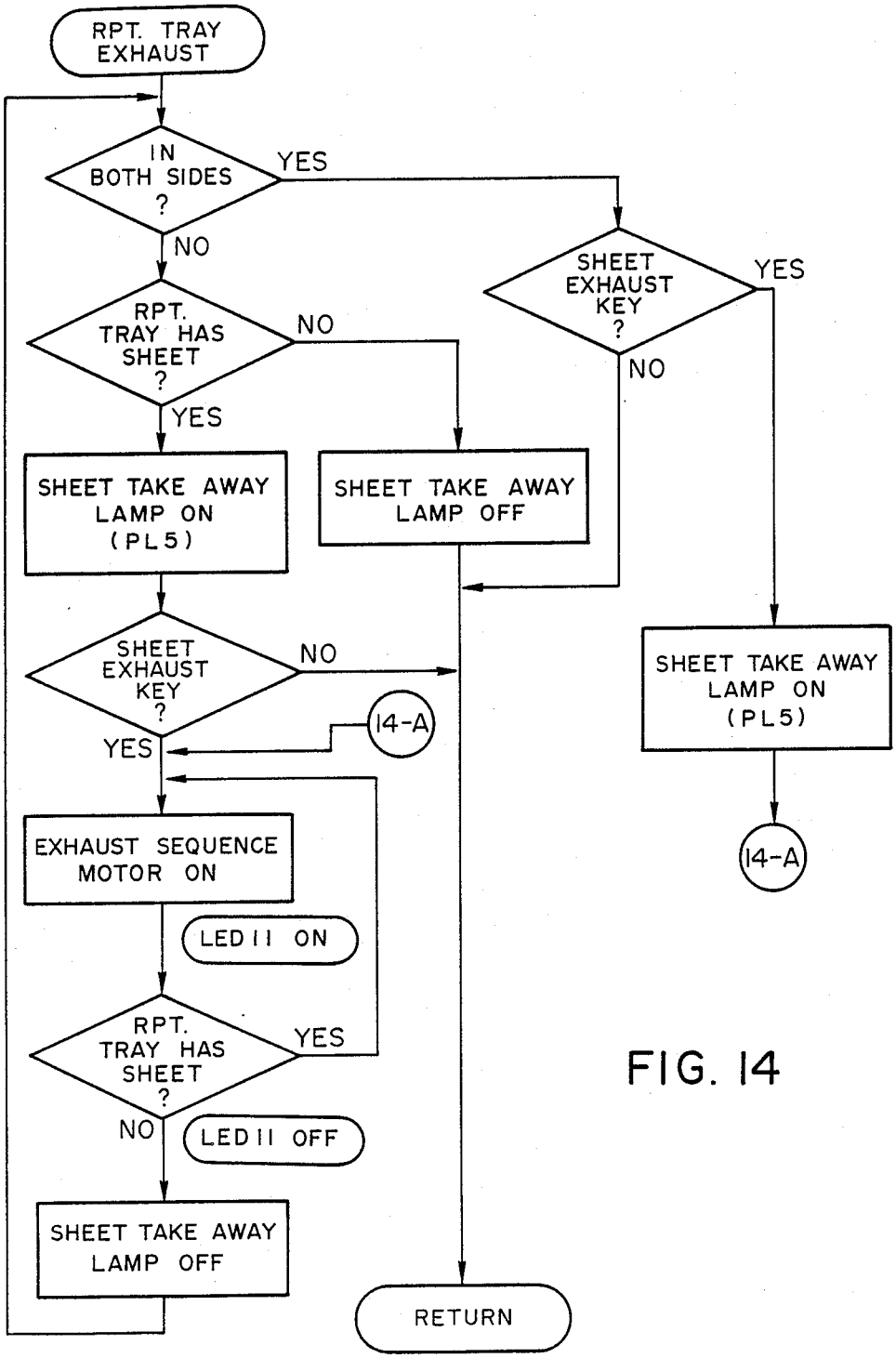

The step 16 identifies the absence of copy sheets in the intermediate tray during the second-face copying in the double-side copy mode, and causes the program to jamp to the point E in FIG. 11, for setting the PEMP 2 flag for preparing deficient copies in the first-face copying mode.

Now there will be given explanations on the various subroutines.

The KEY Subroutine stores the data in the working registers WR(b) and WR(M) (corresponding to the RAM addresses "018" and "01C") according to the following table, thus identifying the actuated keys and setting the corresponding RAM addresses. For example in response to the actuation of a key for image reduction by 0.7 times, a bit for a weight 4 in the RAM address "027" is set to "1".

In this subroutine the disabled keys are identified by the key limitation flag, in order to disable the mode keys other than the copy start key CPY and the clear CL for cancelling the already instructed modes in case of paper jamming, absence of copy sheets etc. Also upon identification of the interruption flag in the double-side copying at the RAM address "07C", the subroutine cancels the entry of the double-side key and regards said entry as if the single-side key is actuated.

| Key | WR(6) | Key | WR(7) |
|---|---|---|---|
| 0 | 0 | D | 0 |
| 1 | 1 | M | 1 |
| 2 | 2 | L | 2 |
| 3 | 3 | Upper | 3 |
| 4 | 4 | Tray | 4 |
| 5 | 5 | Single-side | 5 |
| 6 | 6 | Paper eject | 6 |
| 7 | 7 | RD1 | 7 |
| 8 | 8 | RD2 | 8 |
| 9 | 9 | RD3 | 9 |
| CL | A | Lower | A |
| CPY | B | Sorter | B |
| STP | C | Double-side | C |
| IRPT | D | | |

The JAM Subroutine, in the single-side copy mode, sets the JAMS flag for resetting the I/O device for paper jamming, then transfers the data from CNT3 to CNT2 for indicating the number of effective copies, and cuases the program to return to the stand-by routine after setting the key limitation flag.

A similar procedure is executed in case of jamming in the first-face copying in the double-side copy mode, except that a JAM1 flag is set instead of the JAMS flag.

In case of a jam in the second-face copying in the double-side copy mode, a JAM2 flag is set.

In case of absence of copy sheets in the intermediate tray in this state, the PEMP2 flag is set to restore the copy modes for the first-face copying in order to prepare additional copies for the deficiency, as the second-face copying cannot be continued due to the absence of copy sheets. After the jamming the program awaits the actuation of an unrepresented jam reset button.

The STOP Subroutine functions to set flags in response to the actuation of the stop key STP during the copying operation.

In case of actuation during the single-side copy mode, the STOPS flag and the key limitation flag are set and the program jumps to the point D in FIG. 7 to return to the standby routine.

In case of actuation during the seoncd face copying in the double-side copy mode, the STOP2 flag and the key limitation flag are set and the program jumsp to the point D in FIG. 7.

Also in case of actuation during the first-face copying in the double-side copy mode, the STOP1 flag is set, and the program is shifted to the second-face copying mode with the number of already completed copies taken as the selected copy number in order to prepare double-sided copies, while the initially selected copy number being memorized. In this case the key limitation flag is not set, and the key inputs are processed according to the STOP1 flag.

The PEMP Subroutine identifies the absence of copy sheets in the selected cassette in the copying operation. In case of absence of copy sheets, the subroutine identifies whether the single- or double-side copy mode is in action, and, in case of single-side copy mode, sets a PEMPS flag to cause the program to jump to the point D in FIG. 7. In case of the double-side copy mode, and in the first-face copying, the subroutine sets the PEMPS flag, then stores the data of the selected copy number, transfers the completed copy number to the selected copy number, clears the completed copy number and causes the program to jump to the point D in FIG. 7. In this manner, if the copy sheets are exhausted during the first-face copying, the deficient copies are to be prepared after the double-sided copies are completed on the already existing copy sheets.

In case of absence of copy sheets in the intermetiate tray during the second-face copying, the PEMP2 flag is set to restore the first-face copying mode for preparing the first-face copying mode for the deficient copies.

The OUTLET SWITCH Subroutine identifies the double- or single-side copy mode, and, in case of the latter, identifies whether the tray or sorter is selected as the outlet. In case the sorter is selected, the subroutine identifies if the conveyor is positioned corresponding to the sorter, and, if not, activates a motor M3 and a clutch Cl6 until the conveyor is moved to a position corresponding to the sorter. A similar procedure is executed when the tray is selected.

In case of the first-face copying in the double-side copy mode, the subroutine directs the conveyor to the intermediate tray in a similar procedure, regardless whether the tray or sorter is selected as the final copy outlet.

In the second-face copying the subroutine directs the conveyor to the selected outlet.

The SIZE REDUCTION Subroutine functions according to whether the size instruction is 1:1, the 0.7 reduction or the 0.6 reduction. In case of 1:1 size instruction, the subroutine identifies if the optical system is positioned correspondingly, and, if not, activates a reduction motor M4 until the optical system is moved to a correct position. A similar procedure is executed for other size instruction.

The INTERMEDIATE TRAY EVACUATE Subroutine: In a double-side copier as explained in the foregoing, the intermediate tray may contain copy sheets not requiring image formation on the second face in certain cases to be explained later.

Manual removal of such unnecessary copy sheets involves the cumbersome procedure of opening the apparatus. It is also possible to eject the copy sheets from the intermediate tray by the same procedure as in the second-face copying. This method however is associated with certain difficulties because of absence of distinction between such copy sheets and normal copy sheets. Firstly such method is wasteful in requiring the function of unnecessary process steps. For example such method accelerates the deterioration of the developer, and cannot be performed immediately as the copier is not functionable until the fixing device is brought to an appropriate fixing temperature.

Secondly, if the sorter is in use, the unnecessary copy sheets from the intermediate tray are distributed among the bins of sorter and have to be collected therefrom.

According to the present invention there is provided a mode for ejecting the copy sheets in the intermediate tray (hereinafter called ejection mode), said mode being selectable by the operator and adapted to automatically eject the copy sheets from the intermediate tray without the function of process steps, different from the normal copying process. The process steps mentioned above include image exposure, charging, image development etc. Said ejection mode is automatically cancelled to enable succeeding copying process upon completion of the removal of unnecessary copy sheets from the intermediate tray.

The presence in the intermediate tray of such unnecessary copy sheets not requiring the second-face copying may be caused by the following causes:

1. Error in the first-face copying in the double-side copy mode. Such error includes inadequate copy density, incorrect selection of image magnification or sheet size, and improper positioning of the original document. In these cases the second-face copying is not longer required, and the first-face copying can be conducted anew after the copy sheets in the intermediate tray are ejected by the ejection mode: and 2. Copy sheets remaining in the intermediate tray even before the start of the copying operation. Such case may occur in case the preceding operator left the copy sheets in the intermediate tray for some reason. In such case the succeeding operator can initiate double-side copying only after such left-over copy sheets are removed by the ejection mode from the intermediate tray. Also in case the first-face copying in the double-side copy mode is selected while some copy sheets are present in the intermediate tray, it is desirable to indicate a message requesting the removal of such copy sheets as explained in the foregoing.

A similar situation is encountered when the power supply is interrupted during the first-face copying, or the electric control system loses the memory of the copy mode by erroneous function. In such cases it is impossible to continue the originally intended copying operation when the copier is restored to the normal working state, and the succeeding copying operation is rendered possible by removing the remaining copy sheets from the intermediate tray by the ejection mode.

Such ejection mode, different from normal copying operation, also facilitates the separation of the removed copy sheets from the normal copy sheets.

For example it is possible to eject such unnecessary copy sheets into a dust box exclusively provided for this purpose inside the copier or outside thereof (for example in the sorter), or to eject the unnecessary copy sheets to the tray in case the sorter is in use. Further it is possible to sort the normal and unnecessary sheets by the "lateral alignment" function explained before, if the tray is provided with such function.

The ejection of copy sheets from the intermediate tray is preferably conducted until such copy sheets are exhausted, as detected by appropriate paper detecting means provided in the intermediate tray. However in case the intermediate of the double-side copier is so designed as to accept copies of different originals, namely to accept the copies of odd-numbered faces (1st face, 3rd face, . . . ) in succession and to supply these copies again for copying evennumbered faces and if the ejection mode is selected following the actuation of the stop button in the course of an oddnumbered face copying, it is advisable to eject a number of copies alone from the original for which the actuation of stop button has taken place.

Now there will be explained an embodiment of the present invention applied to the apparatus shown in FIG. 1.

As already explained in the foregoing, the copy sheets are supplied from the first or second paper feed station 18, 19 for the first-face copying and collected in the intermediate tray 17, from which the copy sheets are supplied for the second-face copying and finally ejected to the sorter 30. Now it is assumed that the stop button 45 is actuated in the course of the first-face copying due to a certain error noticed at that time. In this state the copy sheets which have completed the copying process before the actuation of the stop button 45 are collected in the intermediate tray 17. The presence of such copy sheets in the intermediate tray hinders the succeeding renewed first-face copying after the correction of sheet size, for example in case the first-face copying was erroneous with respect to sheet size. In such case, by the actuation of a button 48 for selecting the ejection mode, the copy sheets in the intermediate tray 17 are transported through the path same as in the second-face copying and ejected to the tray 31. The sheet ejection to the tray 31 while the normal copies are ejected to the sorter 30 eliminates the trouble of selecting the unnecessary sheets from the sorter 30. In the sheet ejection from the intermediate tray in the ejection mode, it is to be noted that the components necessary for sheet transport alone are activated while those unnecessary for such transport, such as optical scanning, charging, development and image transfer are inactivated.

It is however possible also to provide a separate transport path through which the copy sheets are ejected from the intermediate tray 17.

As explained detailedly in the foregoing, the present invention provides a double-side image forming apparatus extremely convenient for use. It is further to be understood that the present invention is not limited to the foregoing embodiment but includes any and all variations and modifications within the scope and spirit of the present invention.

What we claim is:

1. A double-side image forming apparatus comprising:

first input means for entering function data related to a desired image formation function;

second input means for entering a number corresponding to a desired number of image bearing members to be subjected to image formation;

memory means for storing the function data entered from said first input means;

storage means for temporarily storing image bearing members between image formations on their opposed faces;

image forming means operable in a first procedure in which an image formation is effected on a first face of an image bearing member in accordance with first function data, followed by said image bearing member being temporarily stored in the storage means, and in a second procedure in which an image formation is effected or a second face of the image bearing member fed from said storage means in accordance with second function data different from the first function data; and control means for providing such a control that a predetermined standard image formation function is set at the time when a power source is turned on, and in the event that there is entry of the function data from said first input means before initiation of said first procedure, the first function data is stored in said memory means, and said image forming means carries out in said first procedure the image formation by the desired number of times entered from said second input means, in accordance with the first function data stored in said memory means, and in the event that after completion of said first procedure there is entry of the function data from said first input means before initiation of said second procedure, the second function data is stored in said memory means, and said image forming means carries out in said second procedure the image formation by the desired number of times entered from said second input means, in accordance with the second function data stored in said memory means, and after completion of the image formation of the desired number of times in said second procedure, said first function data is revived.

2. An apparatus according to claim 1, wherein said image formation function includes at least one of image formation magnification and image formation density.

3. A double-side image forming apparatus, comprising:

first input means for entering function data related to a desired image formation function;

second input means for entering a number corresponding to a desired number of image bearing members to be subjected to image formation;

memory means for storing the function data entered from said first input means;

storage means for temporarily storing image bearing members between image formations on their opposed faces:

image forming means operable in a first procedure in which an image formation is effected on a first face of an image bearing member in accordance with first function data, followed by said image bearing member being temporarily stored in the storage means, and in a second procedure in which an image formation is effected on a second face of the image bearing member fed from said storage means in accordance with second function data different from the first function data;

control means for controlling said image forming means in such a manner that entry of the function data from said first input means and entry of the desired number data from said second input means are permitted before initiation of said first procedure, the first function data is stored in said memory means, and said first procedure is carried out in accordance with the stored first function data, and after completion of said first procedure, entry of the function data from said first input means is permitted, but entry of the desired number data from said second input means is not permitted, before initiation of said second procedure, the second function data is stored in said memory means, and said second procedure is carried out in accordance with the stored second function data; and detecting means for detecting the presence or absence of image bearing members in said storage means;

wherein said control means controls said image forming means so as to perform image formation in accordance with the number of image bearing members entered from said second input means, in the first procedure, and to perform image formation, in the second procedure, until said detecting means detects the absence of image bearing members in said storage means, without regard to the number of image bearing members entered from said second input means.

4. A double-side image forming apparatus according to the claim 3, wherein said control means is adapted to enable image formation in a single-side mode and to disable image formation in a double-side mode when said image bearing members are present in said storage means at the start of said image formation.

5. An apparatus according to claim 3, wherein said image formation function includes at least one of image formation magnification and image formation density.

6. A double-side image forming apparatus, comprising:

first input means for entering function data related to a desired image formation;

second input means for entering a number corresponding to a desired number of image bearing members to be subjected to image formation;

memory means for storing the function data entered from said first input means prior to initiation of image formation;

storage means for temporarily storing image bearing members between image formations on their opposed faces;

image forming means operable in a single-side mode in which an image formation is effected on a first face of an image bearing member in accordance with function data stored in said memory means, followed by said image bearing member being discharged, and in a double-side mode in which an image formation is effected on a first face of an image bearing member in accordance with function data stored in said memory means and thereafter said image bearing member is temporarily stored in the storage means, and further an image formation is effected on a second face of the image bearing member fed from said storage means and thereafter said image bearing member is discharged;

selection means for selecting either said single-side mode or said double-side mode;

signal output means for generating an interruption signal for an interruption image formation during image formation on the number of image bearing members entered from said second input means in said single-side mode or said double-side mode and prior to completion of such image formation; and control means responsive to said interruption signal for interrupting the image formation in execution in the single-side mode or the double-side mode and for providing an interruption image formation mode;

wherein said control means is adapted to disable selection of the double-side mode by said selection means but to enable selection of the single-side mode in the event that the double-side mode is interrupted and the interruption image formation mode is provided, and said control means is adapted to enable selection of the single-side mode or the double-side mode by said selection means in the event that the single-side mode is interrupted and the interruption image formation mode is provided, and wherein said control means is adapted to enable entry from said first input means prior to initiation of the interruption image formation and to enable the interruption image formation in accordance with function data different from one which has been stored in said memory means when said interruption signal is generated.

7. A double-side image forming apparatus according to the claim 6, wherein said control means is adapted, when the image formation during said interruption is completed, to restore automatically the function data in use prior to said interruption.

8. An apparatus according to claim 6, wherein said image formation function includes at least one of image formation magnification and image formation density.

9. A double-side image forming apparatus, comprising:

first input means for entering function data related to a desired image formation;

second input means for entering a number corresponding to a desired number of image bearing members to be subjected to image formation;

memory means for storing the function data entered from said first input means prior to initiation of image formation;

storage means for temporarily storing image forming members between image formations on their opposed faces;

image forming means operable in a single-side mode in which an image formation is effected on a first face of an image bearing member in accordance with function data stored in said memory means, and thereafter said image bearing member is discharged, and in a double-side mode in which an image formation is effected on a first face of an image bearing member in accordance with function data stored in said memory means and thereafter said image bearing member is temporarily stored in said storage means, and further an image formation is effected on second face of the image bearing member fed from said storage means and thereafter said image bearing member is discharged;

selection means for selecting either said single-side mode or said double-side mode;

signal output means for generating an interruption signal for an interruption image formation during image formation on the number of image bearing members entered from said second input means in said single-side mode or said double-side mode and prior to completion of such image formation; and control means responsive to said interruption signal for interrupting the image formation in execution in the single-side mode or the double-side mode and for providing an interruption image formation mode;

wherein said control means is adapted to disable selection of the double-side mode by said selection means in the event that the double-side mode is interrupted and the interruption image formation mode is provided, and said control means is adapted to enable selection of the single-side mode or the double-side mode by said selection means in the event that the single-side mode is interrupted and the interruption image formation mode is provided, and wherein said control means is adapted to enable entry from said first input means prior to initiation of the interruption image formation and to enable the interruption image formation in accordance with function data different from one which has been stored in said memory means when said interruption signal is generated.

10. An apparatus according to claim 9, wherein said image formation function includes at least one of image formation magnification and image formation density.

* * * * *

UNITED STATES PATENT AND TRADEMARK OFFICE

CERTIFICATE OF CORRECTION

PATENT NO. : 4,845,528

DATED : July 4, 1989

INVENTOR(S) : TOMOHIRO AOKI, ET AL.

It is certified that error appears in the above-identified patent and that said Letters Patent is hereby corrected as shown below:

Title page:

IN [63] RELATED U.S. APPLICATION DATA

"Ser. No. 219,587, Dec. 23, 1982," should read
--Ser. No. 219,587, Dec. 23, 1980,--.

IN [30] FOREIGN APPLICATION PRIORITY DATA

"Japan ..... 65-108837
Japan ..... 65-111467 should read

--Japan ..... 55-108837
Japan ..... 55-111467--.

COLUMN 1

Line 7, "Ser. No. 219,587 filed 12/23/82," should read
--Ser. No. 219,587 filed 12/23/80,--.

COLUMN 2

Line 20, "sheetshaped" should read --sheet-shaped--.

COLUMN 3

Line 19, "flush exposure" should read
--flash exposure--.
Line 20, "in to" should read --into--.

UNITED STATES PATENT AND TRADEMARK OFFICE

CERTIFICATE OF CORRECTION

PATENT NO. : 4,845,528

DATED : July 4, 1989

INVENTOR(S) : TOMOHIRO AOKI, ET AL.

It is certified that error appears in the above-identified patent and that said Letters Patent is hereby corrected as shown below:

COLUMN 5

Line 5, "is" should read --in--.
Line 64, "embodiments:" should read --embodiment:--.

COLUMN 6

Line 35, "the ejected" should read --and ejected--.
Line 49, "coping," should read --copying,--.

COLUMN 8

Line 47, "subsequently" should read --subsequent--.

COLUMN 9

Line 31, "operation. (III) In" should read --operation. ¶ (III) In--.
Line 53, "case an" should read --case of an--.

COLUMN 10

Line 67, "operation are" should read --copying mode--.

COLUMN 11

Line 2, "direct-y" should read --directly--.

UNITED STATES PATENT AND TRADEMARK OFFICE

CERTIFICATE OF CORRECTION

PATENT NO. : 4,845,528

DATED : July 4, 1989

INVENTOR(S) : TOMOHIRO AOKI, ET AL.

It is certified that error appears in the above-identified patent and that said Letters Patent is hereby corrected as shown below:

COLUMN 12

Line 5, "tranfer" should read --transfer--.
Line 26, "executed" should read --be executed--.
Line 59, "date" should read --data--.

COLUMN 14

Line 19, "jamp" should read --jump--.
Line 62, "cuases" should read --causes--.

COLUMN 15

Line 15, "seoncd" should read --second--.
Line 17, "jumsp" should read --jumps--.
Line 44, "intermetiate" should read --intermediate--.

COLUMN 16

Line 16, "sheets. Firstly" should read --sheets. ¶ Firstly--.
Line 24, "of sorter" should read --of the sorter--.

COLUMN 17

Line 16, "intermediate" should read --intermediate tray--.

UNITED STATES PATENT AND TRADEMARK OFFICE

CERTIFICATE OF CORRECTION

PATENT NO. : 4,845,528

DATED : July 4, 1989

INVENTOR(S) : TOMOHIRO AOKI, ET AL.

It is certified that error appears in the above-identified patent and that said Letters Patent is hereby corrected as shown below:

COLUMN 18

Line 19, "or" should read --on--.

COLUMN 20

Line 50, "forming" should read --bearing--.
Line 64, "second face" should read --a second face--.

Signed and Sealed this

Twenty-sixth Day of November, 1991

*Attest:*

HARRY F. MANBECK, JR.

*Attesting Officer*

*Commissioner of Patents and Trademarks*